US011264732B2

(12) United States Patent
Naruse

(10) Patent No.: US 11,264,732 B2
(45) Date of Patent: Mar. 1, 2022

(54) ANTENNA MODULE AND COMMUNICATION APPARATUS

(71) Applicant: Murata Manufacturing Co., Ltd., Kyoto (JP)

(72) Inventor: Fumihiko Naruse, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 175 days.

(21) Appl. No.: 16/565,798

(22) Filed: Sep. 10, 2019

(65) Prior Publication Data

US 2020/0006864 A1 Jan. 2, 2020

Related U.S. Application Data

(63) Continuation of application No. PCT/JP2018/015061, filed on Apr. 10, 2018.

(30) Foreign Application Priority Data

Apr. 26, 2017 (JP) ..... JP2017-087446

(51) Int. Cl.
*H01Q 1/38* (2006.01)
*H01Q 1/52* (2006.01)
(Continued)

(52) U.S. Cl.
CPC ..... *H01Q 21/065* (2013.01); *H01Q 1/523* (2013.01); *H01Q 21/0006* (2013.01); *H01Q 23/00* (2013.01)

(58) Field of Classification Search
CPC ..... H01Q 1/2283; H01Q 1/523; H01Q 1/525; H01Q 21/0006–293; H01Q 21/065;
(Continued)

(56) References Cited

U.S. PATENT DOCUMENTS 4,543,579 A * 9/1985 Teshirogi ..... H01Q 21/065 342/365
5,510,803 A * 4/1996 Ishizaka ..... H01Q 21/061 343/700 MS
(Continued)

FOREIGN PATENT DOCUMENTS

CN 102007519 A 4/2011
JP 2011-519517 A 7/2011
(Continued)

OTHER PUBLICATIONS

International Search Report for PCTIJP2018/015061 dated Jun. 19, 2018.
Written Opinion for PCT/JP2018/015061 dated Jun. 19, 2018.

*Primary Examiner* — Tho G Phan
(74) *Attorney, Agent, or Firm* — Pearne & Gordon LLP

(57) ABSTRACT

An antenna module includes a dielectric substrate, multiple patch antennas provided at a first main surface side of the dielectric substrate, and an RFIC mounted at a second main surface side of the dielectric substrate. The multiple patch antennas include multiple sets of antenna groups each composed of the multiple patch antennas periodically arranged at a pitch Px in the X-axis direction, which is one of a polarization direction and a direction perpendicular to the polarization direction. The multiple sets of antenna groups are periodically arranged at a pitch Py in the Y-axis direction, which is the other of the polarization direction and the direction perpendicular to the polarization direction, and each of the multiple sets of antenna groups is arranged so as to be shifted from another antenna group adjacent in the second direction by an offset distance Dx in the first direction.

20 Claims, 10 Drawing Sheets

(51) Int. Cl.
*H01Q 21/06* (2006.01)
*H01Q 21/00* (2006.01)
*H01Q 23/00* (2006.01)

(58) Field of Classification Search
CPC ..... H01Q 21/06; H01Q 1/24; H01Q 1/243; H01Q 1/38; H01Q 1/52; H01Q 1/526; H01Q 21/00; H01Q 23/00
See application file for complete search history.

(56) References Cited

U.S. PATENT DOCUMENTS 6,211,824 B1 * 4/2001 Holden ..... H01Q 1/523 343/700 MS
6,559,798 B1 * 5/2003 Marumoto ..... H01Q 3/2605 342/372
9,196,951 B2 * 11/2015 Baks ..... H01Q 1/2283
10,003,132 B2 * 6/2018 Du ..... H01Q 5/30
10,050,348 B2 * 8/2018 Kawaguchi ..... H01Q 1/38
10,158,173 B2 * 12/2018 Foo ..... H04B 7/0697
10,193,222 B2 1/2019 Mizunuma et al.
10,511,100 B2 * 12/2019 Hester ..... H01Q 1/2225
11,031,700 B2 * 6/2021 Ariumi ..... H01Q 13/08
2009/0256752 A1 10/2009 Akkermans et al.
2010/0053025 A1 3/2010 Van Der Poel
2012/0229362 A1 9/2012 Abe
2015/0234003 A1 * 8/2015 Shiozaki ..... G01R 31/2822 324/763.01

FOREIGN PATENT DOCUMENTS

JP 2012-147105 A 8/2012
JP 2014-195232 A 10/2014
JP 2016-152502 A 8/2016
WO 2016/063759 A1 4/2016
WO 2016/174931 A1 11/2016

* cited by examiner

ANTENNA MODULE AND COMMUNICATION APPARATUS

This is a continuation of International Application No. PCT/JP2018/015061 filed on Apr. 10, 2018 which claims priority from Japanese Patent Application No. 2017-087446 filed on Apr. 26, 2017. The contents of these applications are incorporated herein by reference in their entireties.

BACKGROUND OF THE DISCLOSURE

Field of the Disclosure

The present disclosure relates to an antenna module and a communication apparatus. In particular, the present disclosure relates to a configuration including multiple patch antennas.

Description of the Related Art

Configurations in which multiple patch antennas are arranged at a first main surface side of a dielectric substrate and a radio-frequency element (that is, a radio-frequency circuit component) is mounted on a second main surface opposite to the first main surface of the dielectric substrate are proposed as antenna modules in which multiple patch antennas for wireless communication are integrated with a radio-frequency circuit component (for example, refer to Patent Document 1). In such a configuration, the multiple patch antennas are two-dimensionally arranged in a polarization direction and a direction perpendicular to the polarization direction (such arrangement is hereinafter referred to as "orthogonal arrangement").

Patent Document 1: International Publication No. 2016/063759

BRIEF SUMMARY OF THE DISCLOSURE

In the multiple patch antennas that are orthogonally arranged, it is necessary to decrease the ratio of a pitch (that is, the distance between the centers of adjacent patch antennas) to a free space wavelength ($=\lambda_0$) as much as possible in consideration of a beam pattern in principle.

In particular, since adjacent patch antennas are close to each other in a frequency band having a short $\lambda_0$ (for example, 10 mm or shorter), such as a millimeter wave band, the isolation between the patch antennas may not be ensured. If the isolation is poor, unnecessary signals from another port may wrap around to input-output ports of the radio-frequency circuit component to cause a problem, such as degradation of communication quality. Such a problem is especially prominent in a frequency band, such as the millimeter wave band, in which the short interval between the multiple patch antennas is required to be designed.

In order to resolve the above problem, it is an object of the present disclosure to improve the communication quality in an antenna module in which multiple patch antennas are integrated with a radio-frequency circuit component and a communication apparatus.

In order to achieve the above object, an antenna module according to an embodiment includes a dielectric substrate, multiple patch antennas provided at a first main surface side of the dielectric substrate, and a radio-frequency circuit component that is mounted on a second main surface side opposite to the first main surface of the dielectric substrate. A radio-frequency signal is transmitted between the multiple patch antennas and the radio-frequency circuit component.

The radio-frequency circuit component is arranged in an area in which the multiple patch antennas are arranged in a plan view of the dielectric substrate. The multiple patch antennas include multiple sets of antenna groups each composed of the multiple patch antennas periodically arranged at a first interval in a first direction, which is one of a polarization direction and a direction perpendicular to the polarization direction. The multiple sets of antenna groups are periodically arranged at a second interval in a second direction, which is the other of the polarization direction and the direction perpendicular to the polarization direction. Each of the multiple sets of antenna groups is arranged so as to be shifted from another antenna group adjacent in the second direction by a certain interval in the first direction.

With the above configuration, focusing on the two patch antennas adjacent to each other in the second direction when the multiple patch antennas are orthogonally arranged, one of the two patch antennas is arranged so as to be shifted from the other thereof in the first direction. Accordingly, the interval between the two patch antennas is increased to improve the isolation between the two patch antennas. Consequently, since wrapping-around of unnecessary signals to input-output ports of the radio-frequency circuit component can be suppressed, the communication quality is improved.

The arrangement of the multiple patch antennas composing the multiple sets of antenna groups may be periodically repeated in the first direction and the second direction. When a minimum unit in which the arrangement is periodically repeated is defined as a unit for the multiple patch antennas, multiple units may be arranged at regular intervals along the first direction and at regular intervals along the second direction.

One of the first direction and the second direction is the polarization direction and the other thereof is the direction perpendicular to the polarization direction. Accordingly, the multiple units have the orthogonal arrangement in which the multiple units are two-dimensionally arranged at regular intervals in the polarization direction and the direction perpendicular to the polarization direction by arranging the multiple units at regular intervals along the first direction and at regular intervals along the second direction. Consequently, according to the present embodiment, since the multiple wave sources are orthogonally arranged, as in the normal case in which the multiple patch antennas are orthogonally arranged, when one unit is considered as one wave source, the sidelobe levels can be suppressed. As a result, according to the present embodiment, since the isolations can be improved while suppressing the sidelobe levels, it is possible to further improve the communication quality.

Each of the multiple sets of antenna groups may be arranged so as to be shifted from another adjacent antenna group by an amount approximately half of the first interval in the first direction.

Focusing on one patch antenna of the two patch antennas adjacent to each other in the second direction when the multiple patch antennas are orthogonally arranged, the interval with the other patch antenna is increased as the increasing offset distance in the first direction. However, when the offset distance exceeds half of the first interval, another patch antenna the interval with which is shorter than the interval with the other patch antenna appears. Accordingly, arranging each of the multiple sets of antenna groups so as to be shifted from another adjacent antenna group by an amount approximately half of the first interval in the first direction enables the distance between the patch antennas composing the adjacent antenna groups to be most increased. Accordingly, since the isolation between the patch antennas composing the adjacent antenna groups can be most improved, the communication quality is further improved.

The amount approximately half of the first interval may be within a range of half of the first interval ±2% of the first interval.

If the distance shifted in the first direction is within a range of half of the first interval ±2% of the first interval, isolation similar to that in the case in which the distance is exactly half of the first interval can be ensured.

Each of the multiple patch antennas composing each of the multiple sets of antenna groups may be arranged so as to be shifted from another adjacent patch antenna by a certain interval in the second direction. The arrangement of the multiple patch antennas composing the multiple sets of antenna groups may be periodically repeated in the first direction and the second direction.

With the above configuration, focusing on the two patch antennas adjacent in the first direction when the multiple patch antennas are orthogonally arranged, one of the two patch antennas is arranged so as to be shifted from the other thereof in the second direction. Here, each of the two patch antennas is arranged so as to be shifted in the first direction from the patch antenna adjacent in the second direction in the orthogonal arrangement. In other words, focusing on one patch antenna, in the orthogonal arrangement, the interval between the patch antenna and another patch antenna adjacent in the first direction and the interval between the patch antenna and another patch antenna adjacent in the second direction are increased. Accordingly, since both the isolation between each of the multiple patch antennas composing the antenna module and another patch antenna adjacent in the first direction in the orthogonal arrangement and the isolation between each of the multiple patch antennas composing the antenna module and another patch antenna adjacent in the second direction in the orthogonal arrangement can be improved, the communication quality is further improved.

Each of the multiple sets of antenna groups may be arranged so as to be shifted from another adjacent antenna group by an amount approximately half of the first interval in the first direction. Each of the multiple patch antennas composing each of the multiple sets of antenna groups may be arranged so as to be shifted from another adjacent patch antenna by an amount approximately half of the second interval in the second direction.

With the above configuration, since both the isolation between each of the multiple patch antennas composing the antenna module and another patch antenna adjacent in the first direction in the orthogonal arrangement and the isolation between each of the multiple patch antennas composing the antenna module and another patch antenna adjacent in the second direction in the orthogonal arrangement can be improved, the communication quality is further improved.

The amount approximately half of the first interval may be within a range of half of the first interval ±2% of the first interval, and the amount approximately half of the second interval may be within a range of half of the second interval ±2% of the second interval.

If the distance shifted in the first direction is within a range of half of the first interval ±2% of the first interval and the distance shifted in the second direction is within a range of half of the second interval ±2% of the second interval, isolation similar to that in the case in which the distances are exactly half of the first interval and exactly half of the second interval can be ensured.

The multiple patch antennas composing each of the multiple sets of antenna groups may be arranged on a straight line extending in the first direction.

With the above configuration, it is possible to suppress the sidelobe levels, compared with the case in which the multiple patch antennas composing each of the multiple sets of antenna groups are not arranged on a straight line but are arranged so as to be shifted.

The first direction may be the dielectric perpendicular to the polarization direction and the second direction may be the polarization direction.

The isolation between the patch antennas adjacent in the polarization direction in the orthogonal arrangement is especially poor, compared with the isolation between the other patch antennas. Accordingly, arranging each of the multiple sets of antenna groups so as to be shifted from another antenna group adjacent in the polarization direction, which is the second direction, by a certain interval in the direction perpendicular to the polarization direction enables the isolation between the patch antennas adjacent in the polarization direction in the orthogonal arrangement to be improved. Consequently, since wrapping-around of unnecessary signals to the input-output ports of the radio-frequency circuit component can effectively be suppressed, the communication quality further is improved.

The dielectric substrate may include multiple feeder lines with which each of the multiple patch antennas is connected to the radio-frequency circuit component. The radio-frequency circuit component may include a phase shifter that varies a phase of the radio-frequency signal. The length of each of the multiple feeder lines may be approximately equal to an arbitrary integer multiple of an electrical length corresponding to one step, which is a minimum unit in which the phase of the phase shifter is varied.

With the above configuration, when phase correction with the phase shifter is performed, it is possible to supply electric power of a desired phase to all the multiple patch antennas.

The dielectric substrate may include multiple feeder lines with which each of the multiple patch antennas is connected to the radio-frequency circuit component. The lengths of the feeder lines may be approximately equal to each other.

With the above configuration, since similar losses occur in the multiple feeder lines, it is possible to suppress the degradation of antenna characteristics caused by a variation in the loss.

The fact that the lengths of the feeder lines are approximately equal to each other may mean that a difference between the lengths of the feeder lines is within ±3% of a wavelength of the radio-frequency signal in the dielectric substrate.

For example, when the radio-frequency circuit component includes the phase shifter of 32 steps (that is, the phase shifter of five bits), one step of the phase shifter is 3.125% of the wavelength (that is, the wavelength $\lambda_g$ in the substrate) of the radio-frequency signal in the dielectric substrate. Accordingly, making the difference within 3% of the wavelength of the radio-frequency signal in the dielectric substrate enables the influence of the lengths of the feeder lines 22 on the characteristics to be greatly suppressed. Accordingly, the communication quality is further improved.

The radio-frequency circuit component may be an RFIC that processes the radio-frequency signal.

With the above configuration, it is possible to improve the communication quality for the antenna module in which the multiple patch antennas are integrated with the RFIC.

A communication apparatus according to an embodiment includes the antenna module and a BBIC. The RFIC performs at least one of transmission-system signal processing in which a signal supplied from the BBIC is subjected to up conversion and the signal is supplied to the multiple patch antennas and reception-system signal processing in which radio-frequency signals supplied from the multiple patch antennas are subjected to down conversion and the signals are supplied to the BBIC.

With the communication apparatus described above, providing the above antenna module enables the communication quality to be improved.

According to the present disclosure, it is possible to improve the communication quality for the antenna module in which the multiple patch antennas are integrated with the radio-frequency circuit component and the communication apparatus.

DETAILED DESCRIPTION OF THE DISCLOSURE

Figure 1:
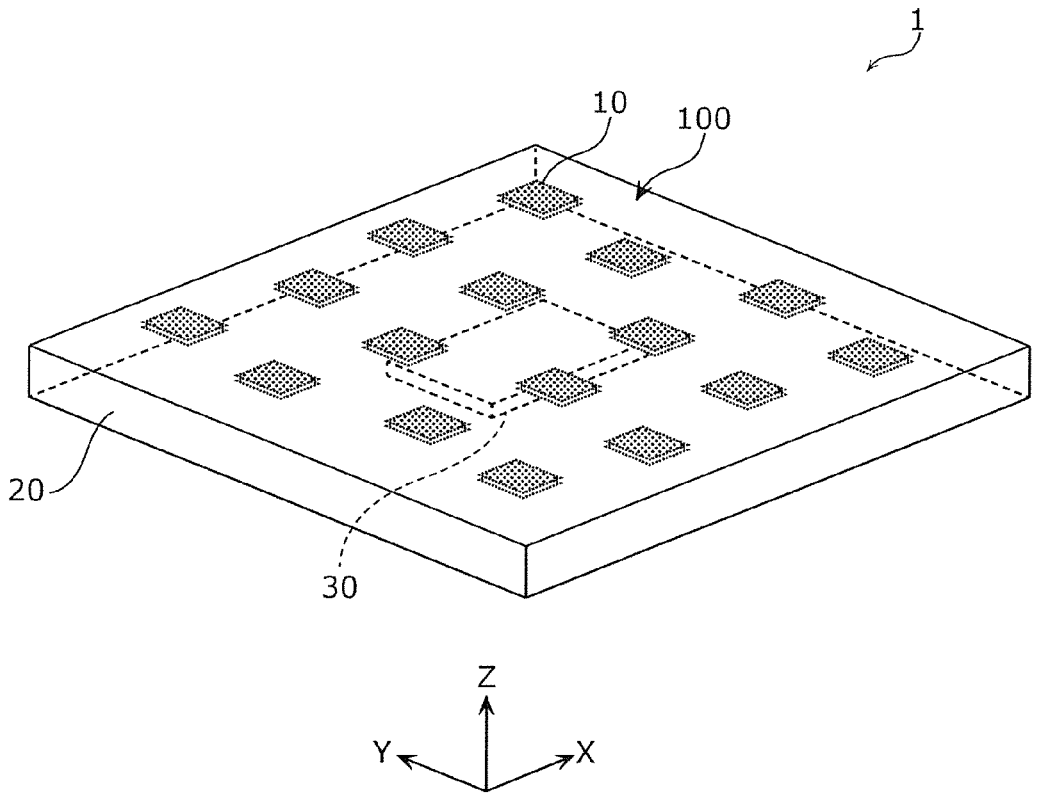
FIG. 1 is an external perspective view of an antenna module according to an embodiment.

Embodiments of the present disclosure will herein be described in detail using examples with reference to the drawings. All the embodiments described below indicate comprehensive or specific examples. Numerical values, shapes, materials, components, the arrangement of the components, the connection mode of the components, and so on, which are indicated in the embodiments described below, are only examples and are not intended to limit the present disclosure. Among the components in the embodiments described below, the components that are not described in the independent claims are described as optional components. In addition, the sizes or the ratios of the sizes of the components illustrated in the drawings are not necessarily strictly indicated. The same reference numerals are used in the respective drawings to identify substantially the same components and a duplicated description of such components may be omitted or simplified.

Embodiment

[1. Antenna module]

Figure 2:
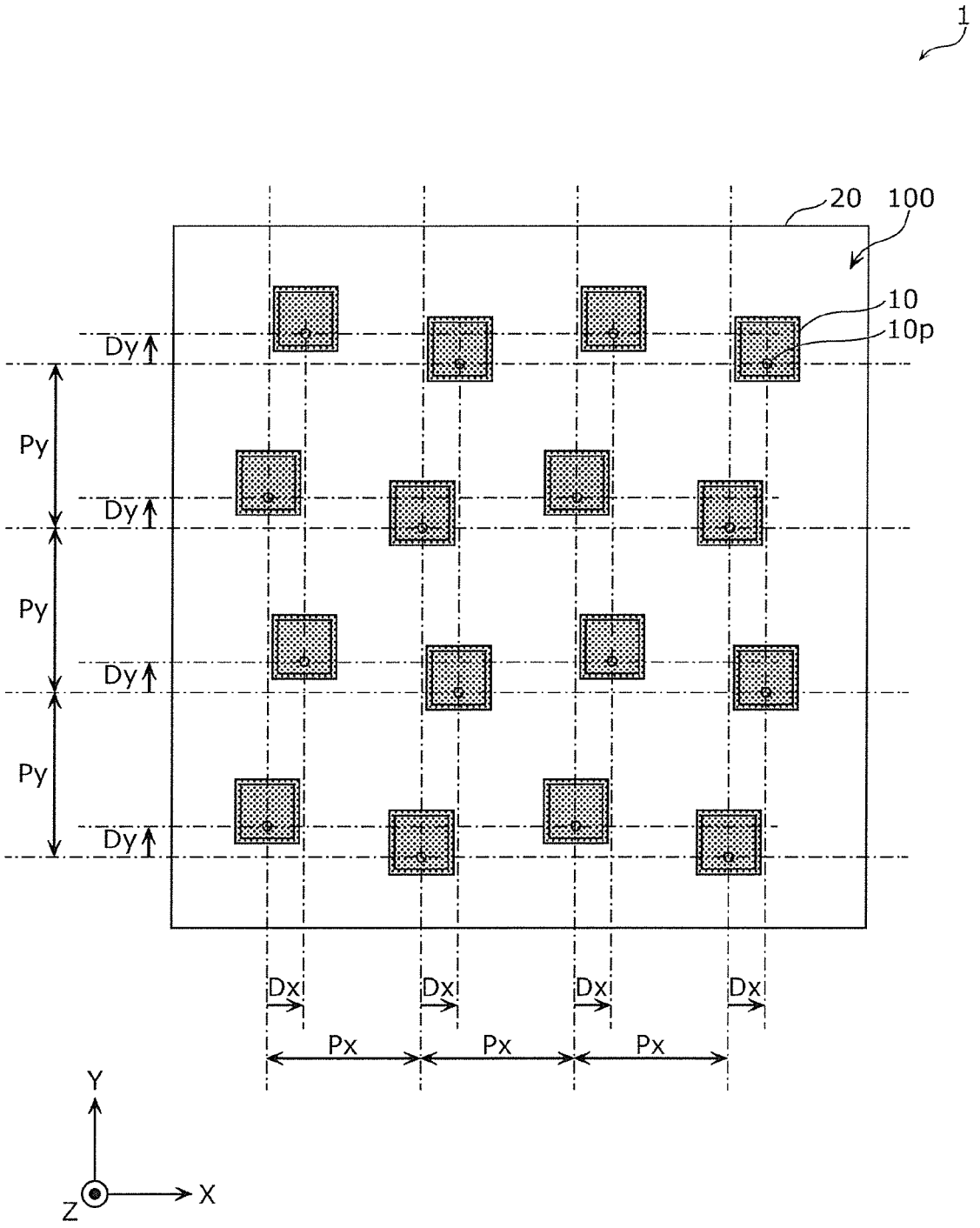
FIG. 2 is a top view of the antenna module according to the embodiment.
Figure 3:
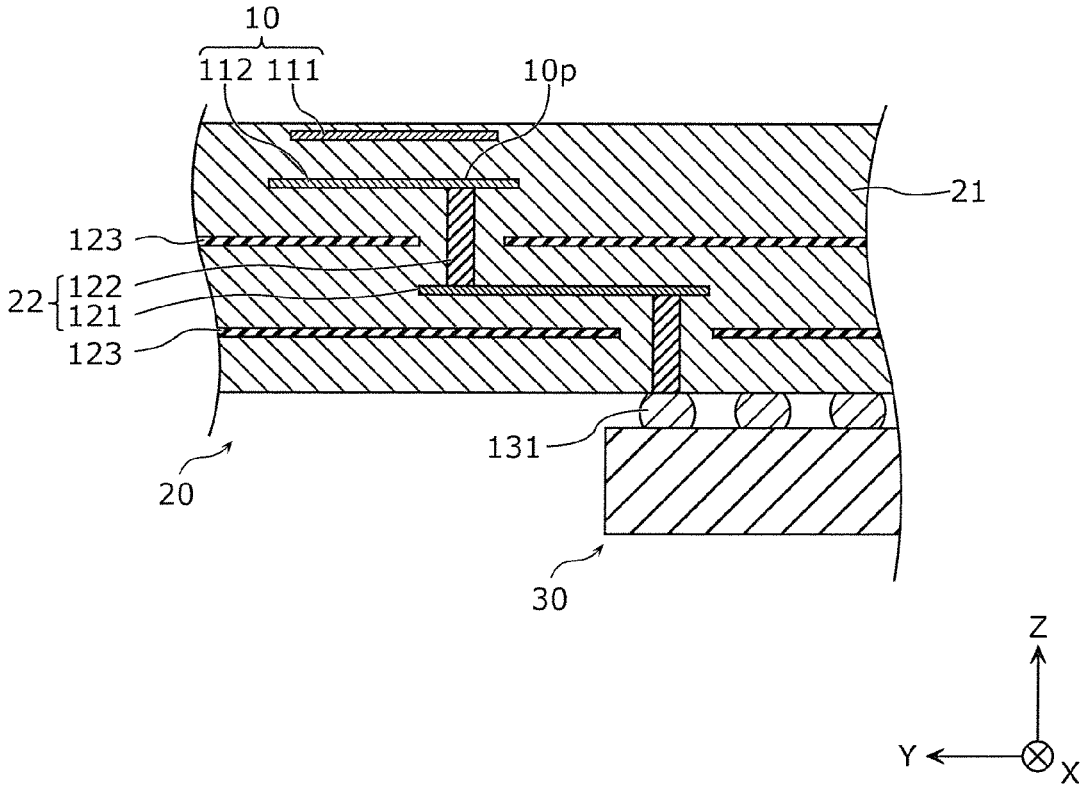
FIG. 3 is a cross-sectional view of a main portion of the antenna module according to the embodiment.

FIG. 1 to FIG. 3 are diagrams illustrating the structure of an antenna module 1 according to an embodiment. Specifically, FIG. 1 is an external perspective view of the antenna module 1 according to the embodiment. FIG. 2 is a top view of the antenna module 1 according to the embodiment. FIG. 3 is a cross-sectional view of a main portion of the antenna module 1. Specifically, FIG. 3 is a cross-sectional view of one of multiple patch antennas 10 composing the antenna module 1 and around the one patch antenna 10.

The pattern electrodes composing the patch antennas 10 are dotted in FIG. 1 and FIG. 2 for simplicity. The same applies to the following schematic diagrams. The multiple patch antennas 10 that are seen through a dielectric substrate 20 and that are provided in the dielectric substrate 20 are illustrated in FIG. 2 for simplicity. The components that strictly exist in other cross sections may be illustrated in the same drawing or the illustration of the components on the same cross section may be omitted in FIG. 3 for simplicity.

The thickness direction of the antenna module 1 is hereinafter described as the Z-axis direction and directions that are perpendicular to the Z-axis direction and that are orthogonal to each other are hereinafter described as the X-axis direction and the Y-axis direction. A Z-axis plus side is described as a top face (upper face) side of the antenna module 1. However, since the thickness direction of the antenna module 1 may not be the vertical direction depending on the actual usage mode, the top face side of the antenna module 1 is not limited to the upper direction.

As illustrated in FIG. 1, the antenna module 1 includes the multiple patch antennas 10, the dielectric substrate 20 having the multiple patch antennas 10 at a first main surface side (the top face side here), and a radio-frequency integrated circuit (RFIC) 30 provided at a second main surface side (the bottom face side here) of the dielectric substrate 20. The multiple patch antennas 10 compose an antenna array 100.

The respective components composing the antenna module 1 will now be specifically described.

The multiple patch antennas 10 are provided at the top face side (the Z-axis plus side), which is the first main surface side of the dielectric substrate 20, and each of the multiple patch antennas 10 emits or receives a radio-frequency signal. In the present embodiment, the antenna module 1 includes the 16 patch antennas 10 composing the antenna array 100 of four rows and four columns.

Specifically, as illustrated in FIG. 2, in the antenna array 100, the patch antennas are arranged so as to be shifted from a reference position to the X-axis plus side by an offset distance Dx every second row and the patch antennas are arranged so as to be shifted from the reference position to the Y-axis plus side by an offset distance Dy every second column, compared with an antenna array of the orthogonal arrangement. Accordingly, the same arrangement mode is repeated for every two rows and every two columns in the antenna array 100 in the present embodiment. In other words, the arrangement of the multiple patch antennas 10 is periodically repeated along the X-axis direction and the Y-axis direction.

The "orthogonal arrangement" here means an arrangement in which the multiple patch antennas 10 are two-dimensionally arranged in a polarization direction and a direction perpendicular to the polarization direction and, in the present embodiment, means an arrangement in which the multiple patch antennas 10 are periodically arranged at a pitch Px (first interval) in the X-axis direction and the multiple patch antennas 10 are periodically arranged at a pitch Py (second interval) in the Y-axis direction. The "reference position" means an arrangement position when the multiple patch antennas 10 are orthogonally arranged. In other words, in the present embodiment, an antenna group composed of four patch antennas arranged in the X-axis direction in the orthogonal arrangement composes one row and an antenna group composed of four patch antennas arranged in the Y-axis direction in the orthogonal arrangement composes one column.

The arrangement mode of the antenna array 100 will be described in detail below.

The respective patch antennas 10 are composed of pattern conductors provided so as to be substantially parallel to each other on the main surface of the dielectric substrate 20 and each include a feeding point 10*p* on the bottom face of the corresponding pattern conductor. The patch antenna 10 emits a radio-frequency signal that is fed in the space or receives a radio-frequency signal in the space. In the present embodiment, the patch antenna 10 emits the radio-frequency signal fed from the RFIC 30 to the feeding point 10*p* in the space or receives the radio-frequency signal in the space to supply the radio-frequency signal from the feeding point 10*p* to the RFIC 30. In other words, the patch antenna 10 in the present embodiment is a radiation element that emits radio waves (the spatially propagating radio-frequency signal) corresponding to the radio-frequency signal transmitted between the patch antenna 10 and the RFIC 30 and is also a reception element that receives the radio waves.

In the present embodiment, the patch antenna 10 has a rectangular shape surrounded by a pair of sides that extend in the Y-axis direction and are opposed to each other in the X-axis direction and a pair of sides that extend in the X-axis direction and are opposed to each other in the Y-axis direction in a plan view of the antenna module 1 (when the antenna module 1 is viewed from the Z-axis plus side) and the feeding point 10*p* is provided at a position shifted from the center point of the rectangular shape to the Y-axis minus side. Accordingly, in the present embodiment, the polarization direction of the radio waves emitted or received by the patch antenna 10 is the Y-axis direction.

The wavelength, the band width ratio, and so on of the radio waves depend on the size of the patch antenna 10 (the magnitude in the Y-axis direction and the magnitude in the X-axis direction here). Accordingly, the size of the patch antenna 10 may be appropriately determined depending on the required specifications, such as the frequency.

Although the patch antenna 10 is built in the dielectric substrate 20 in the present embodiment, the patch antenna 10 may be exposed from the top face of the dielectric substrate 20. In other words, it is sufficient for the patch antenna 10 to be provided at the top face side of the dielectric substrate 20. For example, when the dielectric substrate 20 is composed of a multilayer substrate, it is sufficient for the patch antenna 10 to be provided in an inner layer of the multilayer substrate or on a surface layer thereof.

In addition, the shape of the patch antenna 10 is not limited to the above one. For example, the patch antenna 10 may have a shape in which a pair of corners of the rectangular shape, which are opposed to each other, are cut out or may have a circular shape in a plan view of the antenna module 1 (when the antenna module 1 is viewed from the Z-axis plus side.

The "top face side" here means the upper side of the patch antenna 10 from its center in the vertical direction. In other words, on the dielectric substrate 20 having the first main surface and the second main surface opposite to the first main surface, the "providing the patch antenna 10 at the first main surface side" means that the patch antenna 10 is provided closer to the first main surface, compared with the second main surface. The same hereinafter applies to similar representations of other components.

Although the patch antenna 10 is described above as one pattern conductor having the feeding point 10*p* for simplicity, the patch antenna 10 includes a feed element 112, which is a pattern conductor having the feeding point 10*p*, and a non-feed element 111 that does not have the feeding point 10*p* and that is arranged so as to be apart from the feed element 112 at the top face side of the feed element 112, as illustrated in FIG. 3. The configuration of the patch antenna 10 is not limited to this and, for example, the patch antenna 10 may not include the non-feed element 111.

The dielectric substrate 20 has a substantially rectangular planar shape having a pair of side faces that are opposed to each other in the X-axis direction and a pair of side faces that are opposed to each other in the Y-axis direction in the present embodiment, as illustrated in FIG. 1 and FIG. 2. In addition, the dielectric substrate 20 is a multilayer substrate composed by laminating multiple dielectric layers, as illustrated in FIG. 3, and is composed of a substrate body 21 made of a dielectric material and various conductors composing the patch antennas 10 and so on. The dielectric substrate 20 is not limited to the above one. For example, the dielectric substrate 20 may have a substantially circular planar shape or may be a single-layer substrate.

The various conductors of the dielectric substrate 20 include conductors forming a circuit that composes the antenna module 1 with the patch antennas 10 and the RFIC 30, in addition to the pattern conductors composing the patch antennas 10. The conductors specifically include a pattern conductor 121 and via conductors 122 composing a feeder line 22 through which the radio-frequency signal is transmitted between input-output terminals 131 of the RFIC 30 and the feeding point 10*p* of the patch antenna 10 and a pair of ground pattern conductors 123.

The pattern conductor 121 is provided in the inner layer of the dielectric substrate 20 along the main surface of the dielectric substrate 20. For example, the via conductor 122 connected to the feeding point 10*p* of the patch antenna 10 is connected to the via conductor 122 connected to the input-output terminal 131 of the RFIC 30 with the pattern conductor 121.

The via conductors 122 are provided along the thickness direction, which is vertical to the main surface of the dielectric substrate 20. For example, the via conductors 122 are interlayer connection conductors with which the pattern conductors provided on different layers are connected to each other.

The pair of ground pattern conductors 123 is arranged with the pattern conductor 121 disposed therebetween above and below the pattern conductor 121 and, for example, is provided substantially over the dielectric substrate 20. In the pair of ground pattern conductors 123, for example, only the ground pattern conductor 123 above the pattern conductor 121 may be provided and the ground pattern conductor 123 below the pattern conductor 121 may not be provided.

For example, a low temperature co-fired ceramics (LTCC) substrate or a printed circuit board is used as such a dielectric substrate 20.

The RFIC 30 is a radio-frequency circuit component which is mounted at the bottom face side of the dielectric substrate 20 and through which a radio-frequency signal is transmitted to the multiple patch antennas 10 and composes an RF signal processing circuit that processes the radio-frequency signal. The RFIC 30 performs at least one of transmission-system signal processing in which a signal supplied from a baseband integrated circuit (BBIC) described below is subjected to up conversion and the signal is supplied to the multiple patch antennas 10 and reception-system signal processing in which radio-frequency signals supplied from the multiple patch antennas 10 are subjected to down conversion and the signals are supplied to the BBIC.

In the present embodiment, the RFIC 30 includes multiple input-output terminals 131 composing multiple input-output ports corresponding to the multiple patch antennas 10. The RFIC 30 performs, for example, the up conversion and demultiplexing to the supplied signal and supplies electric power to the multiple patch antennas 10 through the multiple input-output terminals 131 as the transmission-system signal processing. The RFIC 30 performs, for example, multiplexing and the down conversion to the signals that are received with the multiple patch antennas 10 and that are supplied to the multiple input-output terminals 131 and supplies the signals to the BBIC as the reception-system signal processing.

An example of the signal processing in the RFIC 30 will be described below with the configuration of a communication apparatus using the antenna module 1.

The RFIC 30 is arranged at a position opposed to the multiple patch antennas 10, as illustrated in FIG. 1. In other words, the RFIC 30 is arranged in an area of the antenna array 100 in a top view of the dielectric substrate 20. In other words, the RFIC 30 is arranged in the area in which the multiple patch antennas 10 are arranged in the top view. With this arrangement, it is possible to shorten the feeder lines connecting the RFIC 30 to the respective patch antennas 10.

The area of the antenna array 100 is a minimum area including the multiple patch antennas 10 in a top view of the dielectric substrate 20 and is an area having a substantially rectangular shape in the present embodiment. Positioning the RFIC 30 in the area of the antenna array 100 means that at least part of the RFIC 30 is positioned in the area of the antenna array 100 and specifically means that the entire RFIC 30 is positioned in the area of the antenna array 100. Arranging the RFIC 30 in the above manner enables the feeder lines 22 to be shortened for all the patch antennas 10.

With the above configuration, the loss caused by the feeder lines 22 is reduced to realize the antenna module 1 with high performance. Such an antenna module is preferable to an antenna module in the millimeter wave band in which the lengths of the feeder lines 22 have large influence on the loss.

With regard to this, in the present embodiment, the lengths of the multiple feeder lines 22 connecting the respective multiple patch antennas 10 to the RFIC 30 are approximately equal to each other. Here, the lengths of the multiple feeder lines 22 that are approximately equal to each other not only means that the lengths of the multiple feeder lines 22 are completely equal to each other but also means that it is sufficient for the lengths of the multiple feeder lines 22 to be approximately equal to each other, and the lengths of the multiple feeder lines 22 may be different from each other within an error range. Specifically, "the lengths are approximately equal to each other" means that the difference between the lengths of the multiple feeder lines 22 is within 3% of the wavelength of the radio-frequency signal in the dielectric substrate 20. In other words, the lengths of the multiple feeder lines 22 are approximately equal to each other means that the difference, which is a variation in length of the multiple feeder line 22, is within 3% of the wavelength of the radio-frequency signal in the dielectric substrate 20.

The shape of the area of the antenna array 100 corresponds to the arrangement mode of the multiple patch antennas 10 and is not limited to the substantially rectangular shape.

[1-2. Arrangement Mode of Antenna Array]

[1-2-1. Detailed Background of Present Disclosure]

Next, the arrangement mode of the antenna array 100 in the present embodiment will now be described with the detailed background of the development of the arrangement mode.

The inventors of the present application have found that communication quality may be degraded because of poor isolation between adjacent patch antennas in the development of the antenna module in which the multiple patch antennas are integrated with the radio-frequency circuit component.

Specifically, the radio-frequency circuit component is generally frequently arranged outside the area of the antenna array. However, since the feeder lines are likely to be lengthened in such arrangement, a configuration in which the radio-frequency circuit component is arranged in the area of the antenna array and at the rear face side of the dielectric substrate having the multiple patch antennas provided thereon may be selected in a frequency band, such as the millimeter wave band, in which the lengths of the feeder lines have large influence on the loss. In contrast, when the lengths of the feeder lines are decreased, unnecessary signals easily wrap around to the radio-frequency circuit component if the isolation between the patch antennas is not ensured. Accordingly, it causes another problem that the communication quality is likely to be degraded. Such a problem is especially prominent in a frequency band, such as the millimeter wave band, in which the short interval between the adjacent patch antennas is required to be designed in principle in consideration of a beam pattern.

Accordingly, the inventors of the present application have supposed a configuration in which, in the antenna module in which the multiple patch antennas are integrated with the radio-frequency circuit component, the interval between the adjacent patch antennas is increased by shifting the arrangement mode of the antenna array from the orthogonal arrangement to improve the isolation between the patch antennas, thereby improving the communication quality.

[1-2-2. Design in Embodiment]

Figure 4A:
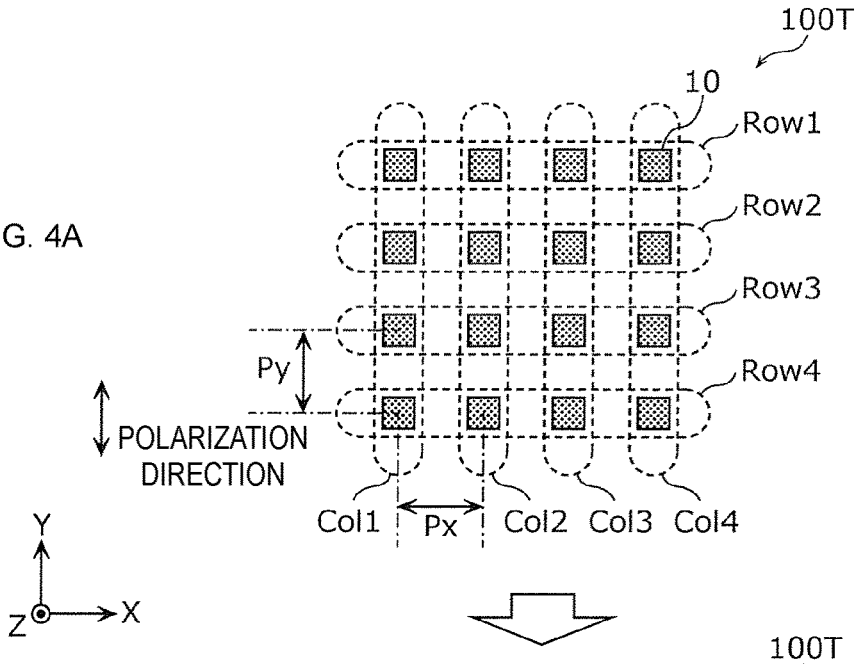
FIGS. 4A, 4B and 4C include schematic diagrams for describing the arrangement mode of an antenna array in the present embodiment.
Figure 4B:
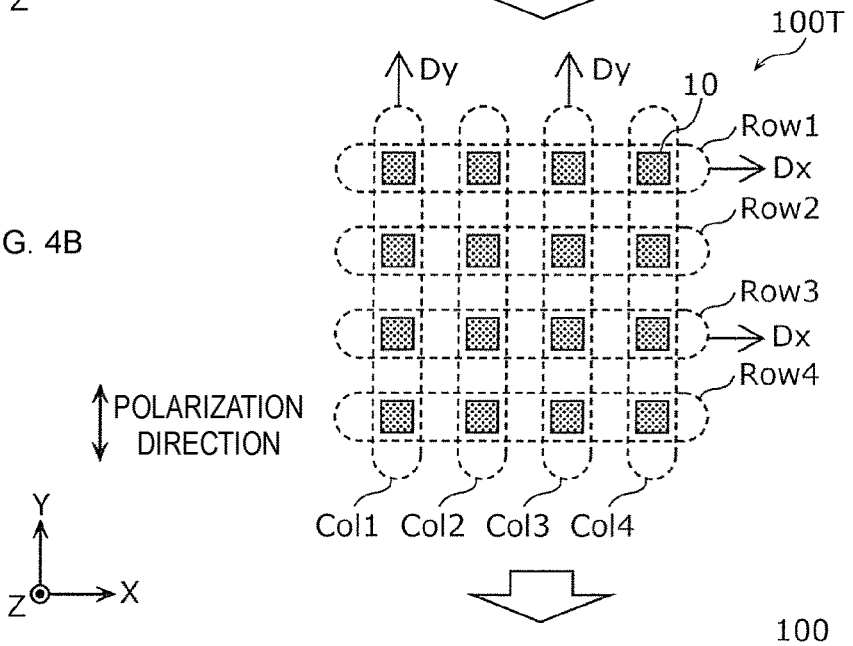
Figure 4C:
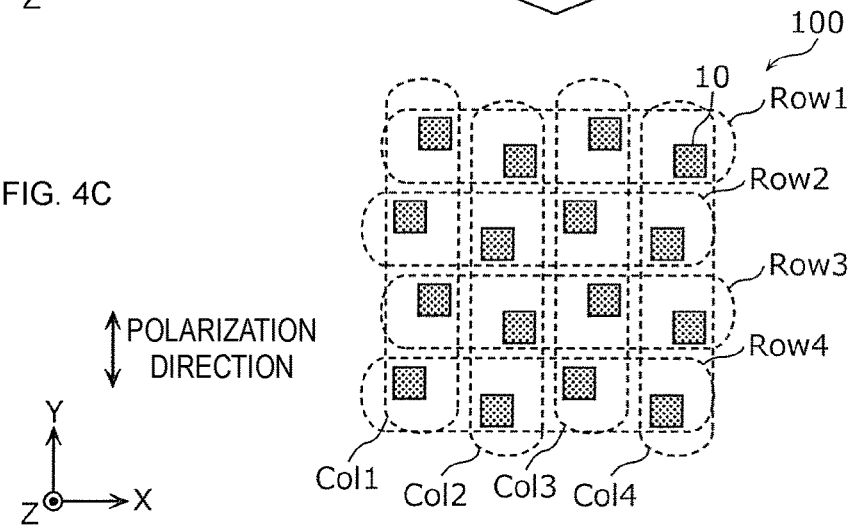

FIGS. 4A, 4B and 4C include schematic diagrams for describing the arrangement mode of the antenna array 100 in the present embodiment.

First, as illustrated in FIG. 4A, an antenna array 100T on which the antenna array 100 in the present embodiment is based is designed. The antenna array 100T is composed of the patch antennas 10 of four rows and four columns that are orthogonally arranged.

Specifically, four antenna groups Row1 to Row4 composing the antenna array 100T are each composed of four patch antennas 10 that are periodically arranged at the pitch Px in the X-axis direction. These four antenna groups Row1 to Row4 are periodically arranged at the pitch Py in the Y-axis direction.

In other words, four antenna groups Co11 to Co14 composing the antenna array 100T are each composed of four patch antennas 10 that are periodically arranged at the pitch Py in the Y-axis direction. These four antenna groups Co11 to Co14 are periodically arranged at the pitch Px in the X-axis direction.

In the antenna array 100T of the orthogonal arrangement arranged in the above manner, the patch antennas 10 of odd-number-th antenna groups Row1 and Row3 are shifted to the X-axis plus side by the offset distance Dx and the patch antennas 10 of odd-number-th antenna groups Co11 and Co13 are shifted to the Y-axis plus side by the offset distance Dy, as illustrated in FIG. 4B.

This composes the antenna array 100 in which the patch antennas 10 are shifted from the reference position to the X-axis plus side by the offset distance Dx every second row and the patch antennas 10 are shifted from the reference position to the Y-axis plus side by the offset distance Dy every second column, compared with the antenna array 100T of the orthogonal arrangement, as illustrated in FIG. 4C.

In other words, the antenna array 100 in the present embodiment includes multiple sets (four sets here) of the antenna groups Row1 to Row4 each composed of the multiple patch antennas 10 (four patch antennas 10 here), which are periodically arranged at the pitch Px in the X-axis direction, which is an example of a first direction. The multiple sets of the antenna groups Row1 to Row4 are periodically arranged at the pitch Py in the Y-axis direction, which is an example of a second direction. Each of the multiple sets of the antenna groups Row1 to Row4 is arranged so as to be shifted from another adjacent antenna group by a certain interval (the offset distance Dx) in the X-axis direction. Specifically, in the present embodiment, the odd-number-th antenna groups Row1 and Row3 and the even-number-th antenna groups Row2 and Row4 are arranged so as to be shifted from each other in the X-axis direction.

Accordingly, focusing on each patch antenna 10 in the antenna array 100, another adjacent patch antenna in each of the antenna groups Co11 to Co14 is shifted from the patch antenna 10 in the X-axis direction by the offset distance Dx while keeping the pitch Py in the Y-axis direction. Consequently, the distance between the adjacent patch antennas on the same column is increased, compared with the orthogonal arrangement.

In addition, in each of the multiple sets of the antenna groups Row1 to Row4 in the antenna array 100, each of the multiple patch antennas 10 composing the antenna groups Row1 to Row4 is arranged so as to be shifted from another adjacent patch antenna 10 in the Y-axis direction by the offset distance Dy. Specifically, the odd-number-th antenna groups Co11 and Co13 are arranged so as to be shifted from the even-number-th antenna groups Co12 and Co14 in the Y-axis direction in the present embodiment.

Accordingly, focusing on each patch antenna 10 in the antenna array 100, other adjacent patch antennas in each of the antenna groups Row1 to Row4 are shifted from the patch antenna 10 in the Y-axis direction by the offset distance Dy while keeping the pitch Px in the X-axis direction. Consequently, the distance between the adjacent patch antennas on the same row is increased, compared with the orthogonal arrangement.

As described above, focusing on each patch antenna 10 in the antenna array 100 in the present embodiment, both the distance from another adjacent patch antenna 10 on the same row and the distance from another adjacent patch antenna 10 on the same column are increased, compared with the orthogonal arrangement.

Although both the rows and the columns are shifted, compared with the orthogonal arrangement, in the antenna array 100 in the present embodiment, only one of the rows and the columns may be shifted.

Figure 5A:
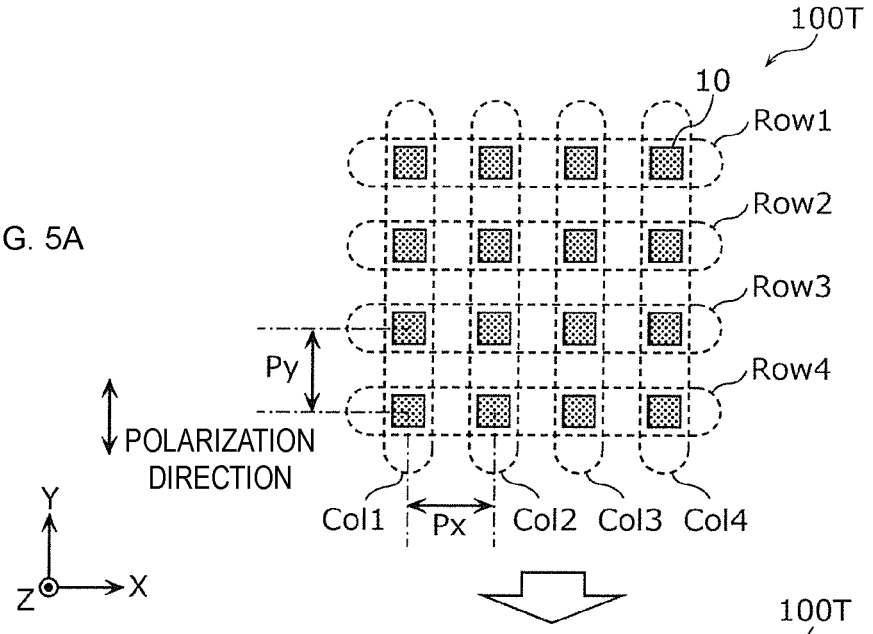
FIGS. 5A, 5B and 5C include schematic diagrams for describing the arrangement mode of an antenna array in a first modification of the present embodiment.
Figure 5B:
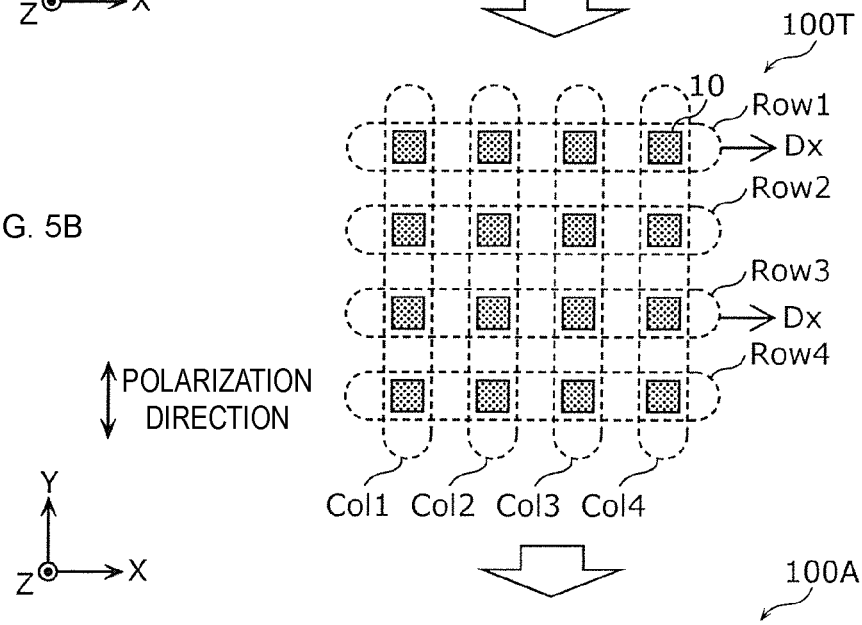
Figure 5C:
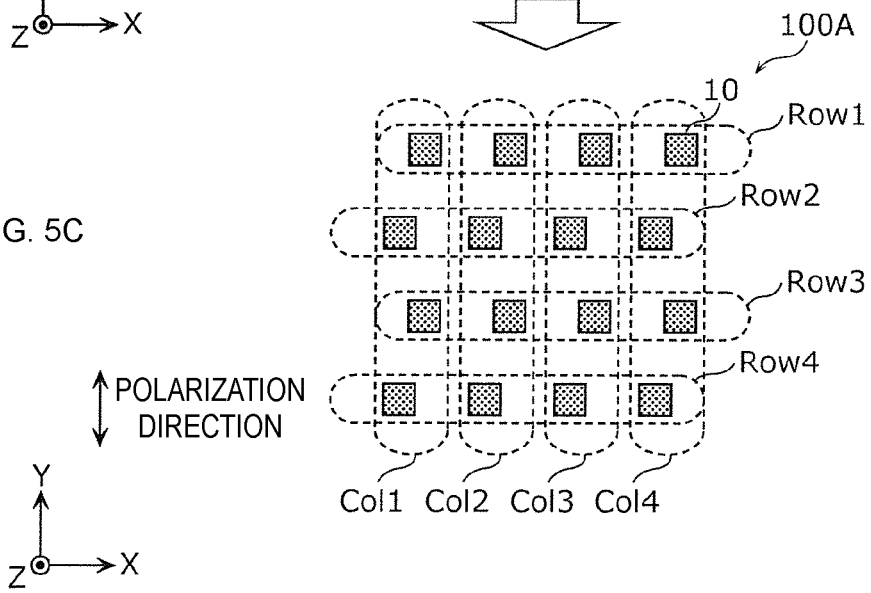

FIGS. 5A, 5B and 5C include schematic diagrams for describing the arrangement mode of an antenna array 100A in a first modification of the embodiment.

As illustrated in FIG. 5A and FIG. 5B, in the antenna array 100T of the orthogonal arrangement, the patch antennas 10 in the odd-number-th antenna groups Row1 and Row3 are shifted to the X-axis plus side by the offset distance Dx and the patch antennas 10 in all the antenna groups Co11 to Co14 are not shifted in the Y-axis direction.

This composes the antenna array 100A in which the patch antennas 10 are shifted from the reference position to the X-axis plus side by the offset distance Dx every second row, compared with the antenna array 100T of the orthogonal arrangement, as illustrated in FIG. 5C. Specifically, in the antenna array 100A, the multiple patch antennas 10 composing each of the multiple sets of the antenna groups Row1 to Row4 are arranged on a straight line extending in the X-axis direction and the adjacent patch antennas in the multiple patch antennas 10 composing each of the multiple sets of the antenna groups Co11 to Co14 are arranged so as to be shifted from each other in the X-axis direction.

Figure 6A:
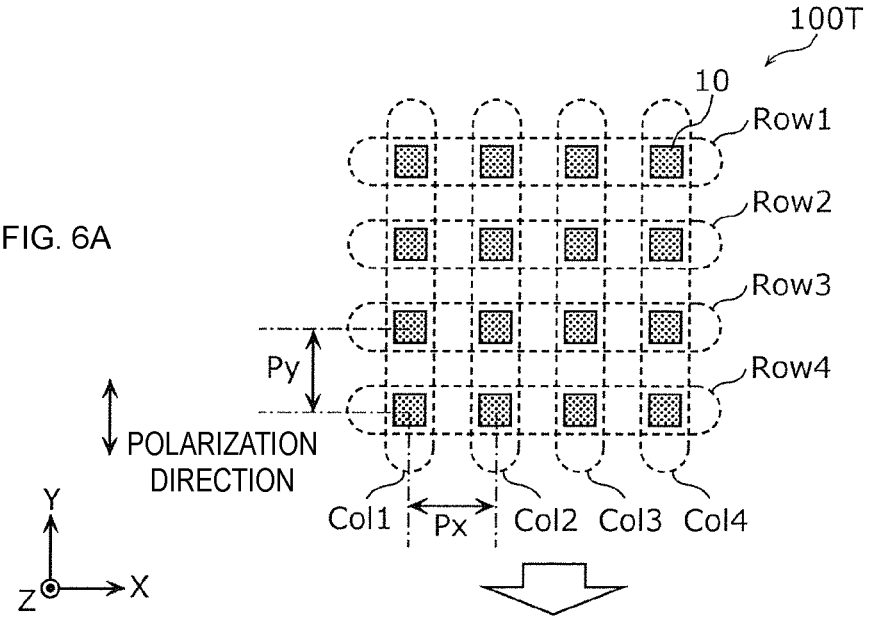
FIGS. 6A, 6B and 6C include schematic diagrams for describing the arrangement mode of an antenna array in a second modification of the embodiment.
Figure 6B:
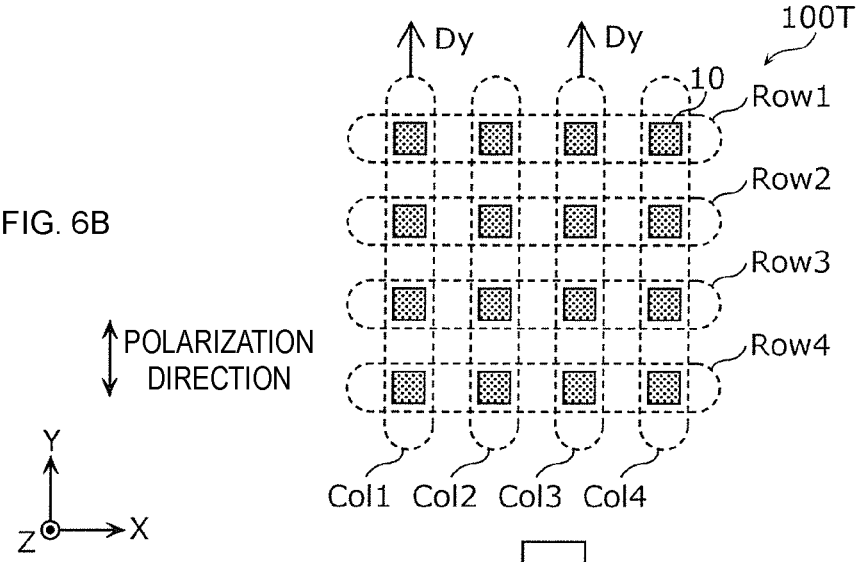
Figure 6C:
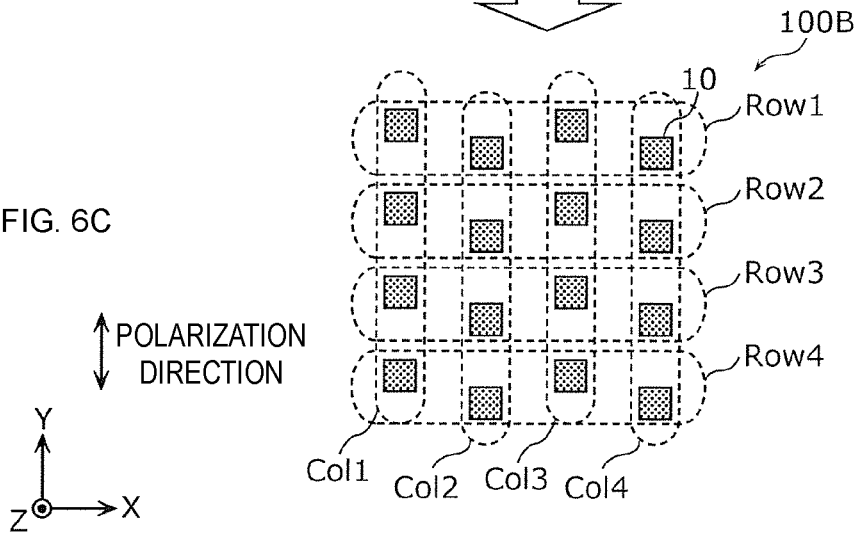

FIGS. 6A, 6B and 6C include schematic diagrams for describing the arrangement mode of an antenna array 100B in a second modification of the embodiment.

As illustrated in FIG. 6A and FIG. 6B, in the antenna array 100T of the orthogonal arrangement, the patch antennas 10 in the odd-number-th antenna groups Co11 and Co13 are shifted to the Y-axis plus side by the offset distance Dy and the patch antennas 10 in all the antenna groups Row1 to Row4 are not shifted in the X-axis direction.

This composes the antenna array 100B in which the patch antennas 10 are shifted from the reference position to the Y-axis plus side by the offset distance Dy every second column, compared with the antenna array 100T of the orthogonal arrangement, as illustrated in FIG. 6C. Specifically, in the antenna array 100B, the multiple patch antennas 10 composing each of the multiple sets of the antenna groups Co11 to Co14 are arranged on a straight line extending in the Y-axis direction and the adjacent patch antennas in the multiple patch antennas 10 composing each of the multiple sets of the antenna groups Row1 to Row4 are arranged so as to be shifted from each other in the Y-axis direction.

[1-2-3. Comparison by Simulation]

Next, the advantages of the antenna arrays in the present embodiment and the first and second modifications of the embodiment will be described using a first simulation model and a second simulation model.

Figure 7:
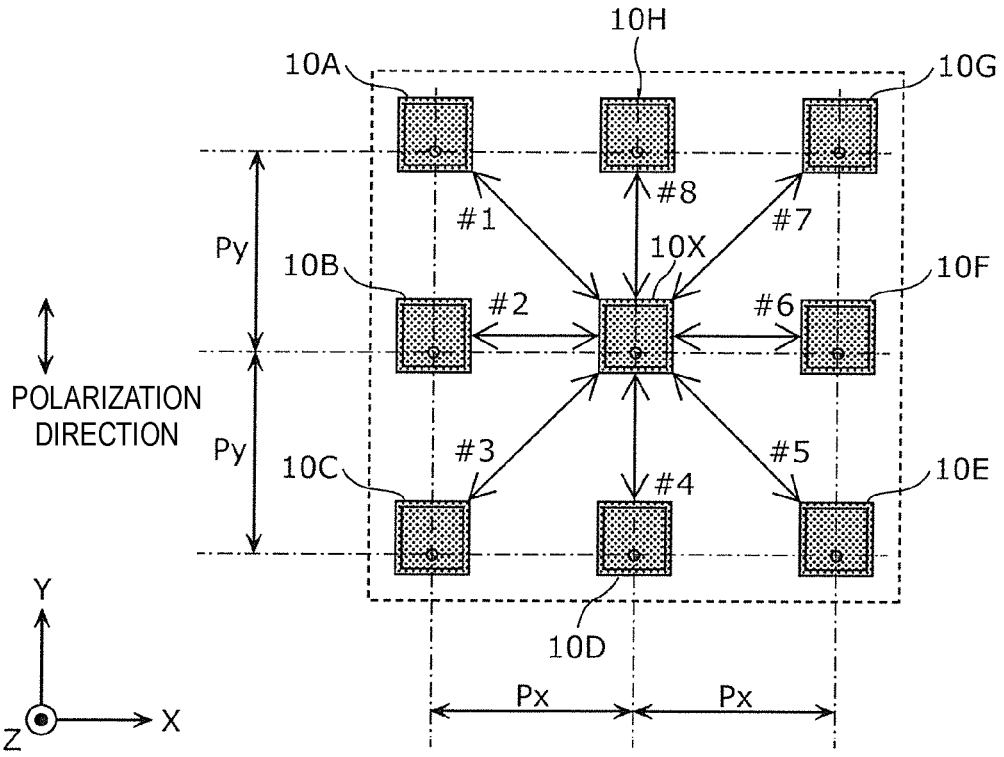
FIG. 7 is a top view illustrating the arrangement mode of an antenna array in a first simulation model.

FIG. 7 is a top view illustrating the arrangement mode of an antenna array in the first simulation model.

Figure 8:
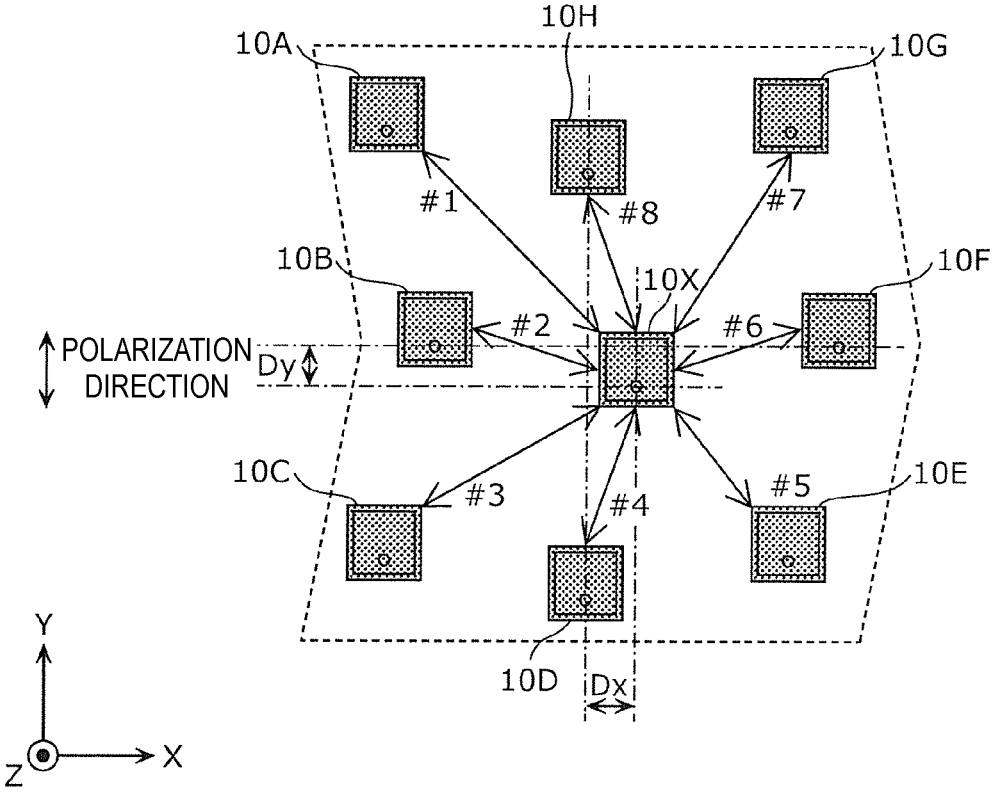
FIG. 8 is a top view illustrating the arrangement mode of an antenna array in a second simulation model.

As illustrated in FIG. 7, the first simulation model corresponds to part of the antenna array 100T, which is orthogonally arranged. Accordingly, in the first simulation model, nine patch antennas 10A to 10H and 10X are orthogonally arranged. Each of the nine patch antennas 10A to 10H and 10X corresponds to the patch antenna 10 in the present embodiment. Each of the eight patch antennas 10A to 10H are arranged so as to be adjacent to the patch antenna 10X and specifically has the following positional relationship to the patch antenna 10X:

The patch antenna 10A: positioned on a column at the X-axis minus side and a row at the Y-axis plus side The patch antenna 10B: positioned on a column at the X-axis minus side and the same row The patch antenna 10C: positioned on a column at the X-axis minus side and a row at the Y-axis minus side The patch antenna 10D: positioned on the same column and a row at the Y-axis minus side The patch antenna 10E: positioned on a column at the X-axis plus side and a row at the Y-axis minus side The patch antenna 10F: positioned on a column at the X-axis plus side and the same row The patch antenna 10G: positioned on a column at the X-axis plus side and a row at the Y-axis plus side The patch antenna 10H: positioned on the same column and a row at the Y-axis plus side FIG. 8 is a top view illustrating the arrangement mode of an antenna array in the second simulation model.

As illustrated in FIG. 8, the second simulation model corresponds to part of the antenna arrays in the present embodiment and the first and second modifications of the embodiment, which are arranged so as to be shifted from the orthogonal arrangement. Accordingly, in the second simulation model, the arrangement positions of the patch antennas 10A to 10H with respect to the patch antenna 10X are different from those in the first simulation model.

Figure 9:
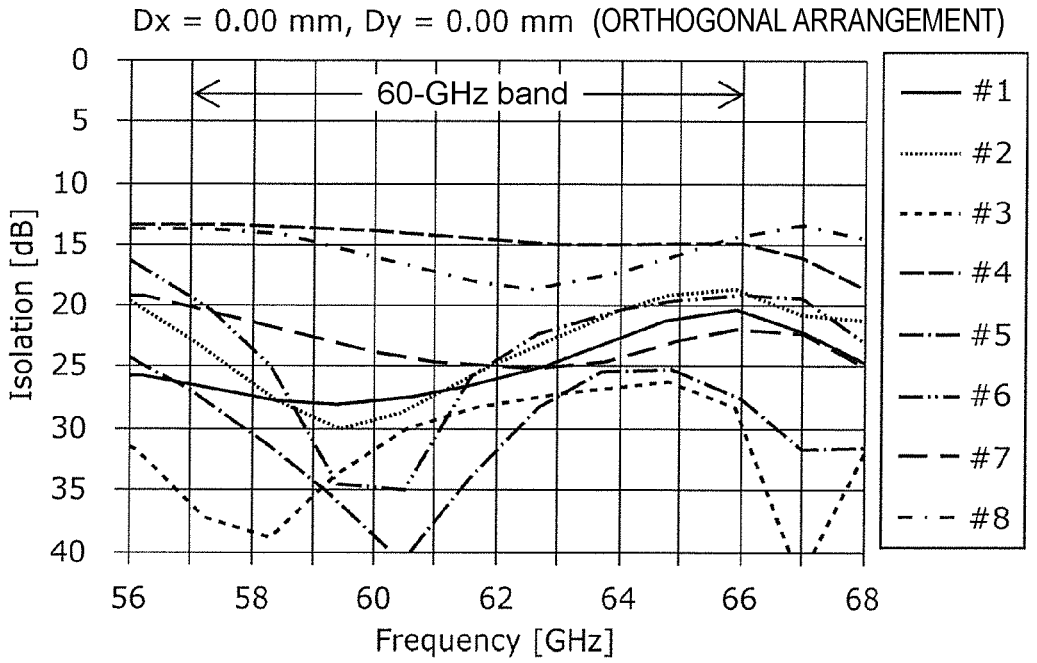
FIG. 9 is a graph representing isolation characteristics in the first simulation model.
Figure 10:
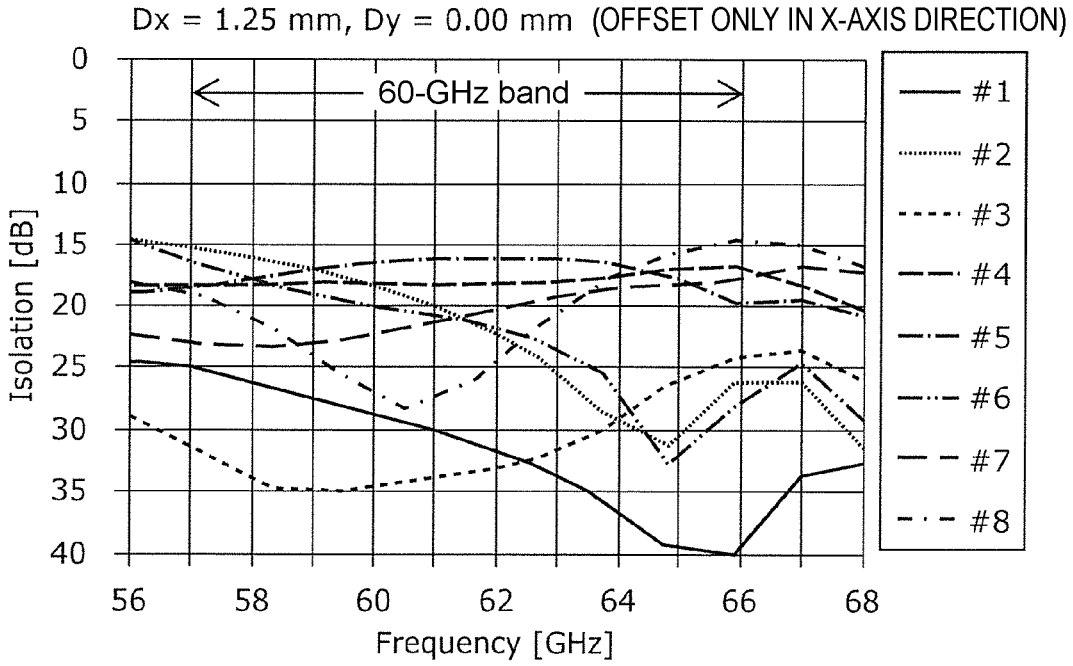
FIG. 10 is a graph representing the isolation characteristics in the second simulation model when Dx=1.25 mm and Dy=0.00 mm.
Figure 11A:
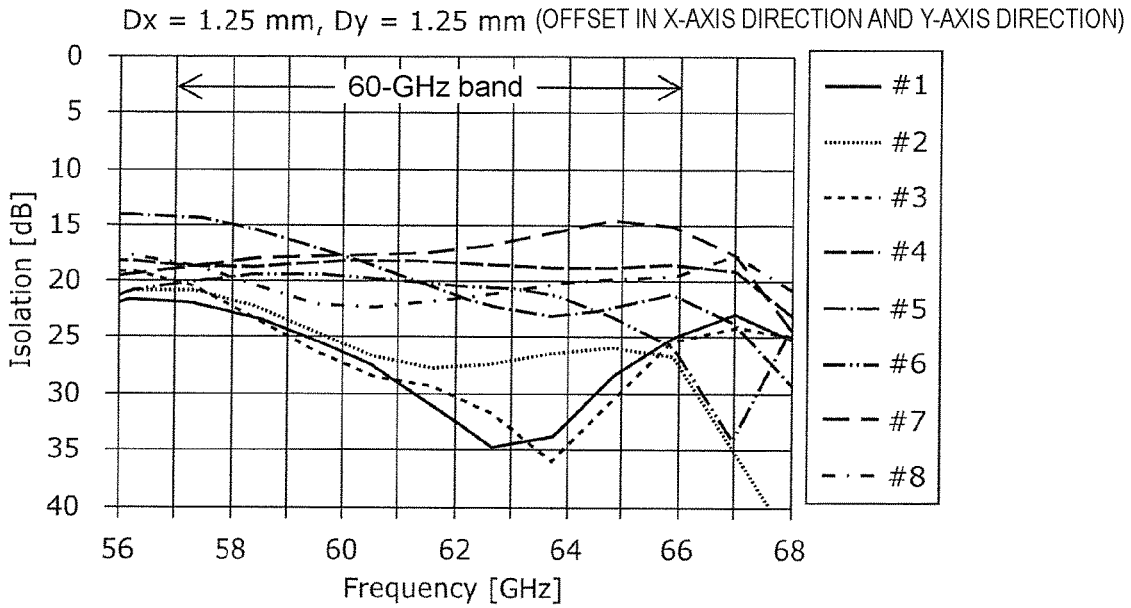
FIG. 11A is a graph representing the isolation characteristics in the second simulation model when Dx=1.25 mm and Dy=1.25 mm.
Figure 11B:
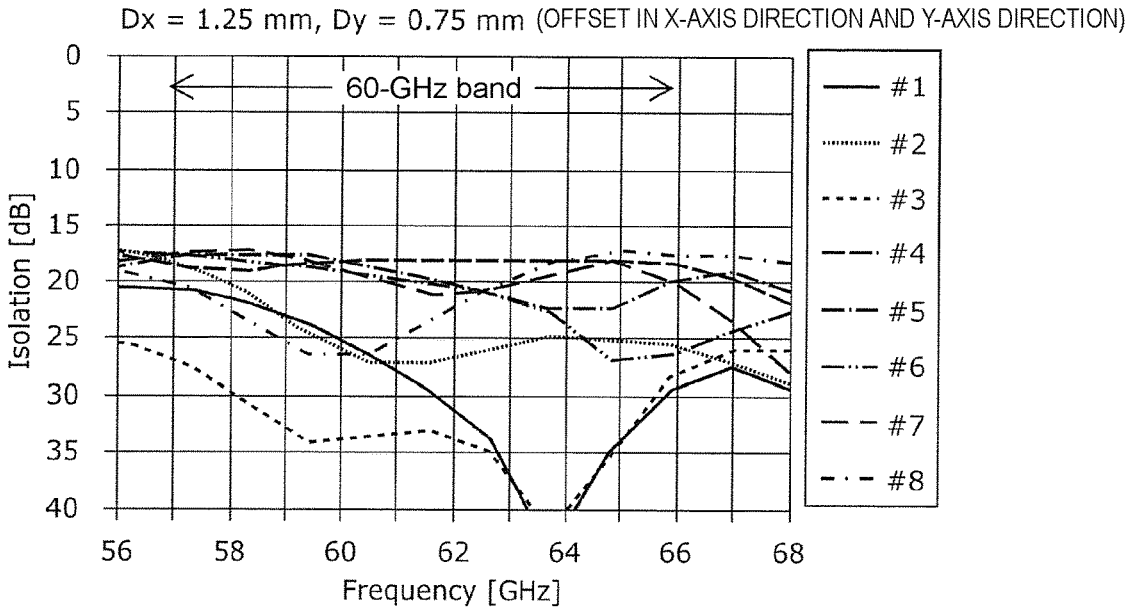
FIG. 11B is a graph representing the isolation characteristics in the second simulation model when Dx=1.25 mm and Dy=0.75 mm.

FIG. 9 is a graph representing isolation characteristics in the first simulation model. Specifically, the isolation in the case of the orthogonal arrangement in which Dx=0.00 mm and Dy=0.00 mm is represented in FIG. 9. FIG. 10 is a graph representing the isolation characteristics in the second simulation model when Dx=1.25 mm and Dy=0.00 mm. FIG. 11A is a graph representing the isolation characteristics in the second simulation model when Dx=1.25 mm and Dy=1.25 mm. FIG. 11B is a graph representing the isolation characteristics in the second simulation model when Dx=1.25 mm and Dy=0.75 mm.

Isolations #1 to #8, which are isolations between the patch antenna 10X and the respective patch antenna 10A to 10H, are illustrated in these drawings. More specifically, the absolute values of the intensity ratios of the radio-frequency signals propagated to the respective patch antennas 10A to 10H to the radio-frequency signal emitted from the patch antenna 10X are illustrated in these drawings.

In both the first simulation model and the second simulation model, the same conditions are set except for the matters concerning the offset distances Dx and DY from the reference position. Specifically, the polarization direction is set to the Y-axis direction, the pitch Px in the X-axis direction and the pitch Py in the Y-axis direction are set to 2.50 mm, and a used frequency band is from 57 GHz to 66 GHz (a 60 GHz band).

As apparent from FIG. 9, #2, #4, #6, and #8 are poor and #2 and #6 are especially poor in the 60 GHz band, which is the used frequency band, in the orthogonal arrangement. Here, #2 is the isolation between the patch antenna 10X and the patch antenna 10B, #4 is the isolation between the patch antenna 10X and the patch antenna 10D, #6 is the isolation between the patch antenna 10X and the patch antenna 10F, and #8 is the isolation between the patch antenna 10X and the patch antenna 10H. In other words, in the orthogonal arrangement, the isolation between the patch antennas adjacent to each other in the polarization direction or the direction orthogonal to the polarization direction is poor and, especially, the isolation between the patch antennas adjacent to each other in the polarization direction is poor.

With regard to this, #4 and #8, which are the isolations between the patch antennas adjacent to each other in the polarization direction, are indicated in Table 1 when the offset distance Dy is fixed to Dy=0.00 mm and only the offset distance Dx is varied at intervals of 0.25 mm. Since the other isolations are degraded, compared with #4 and #8, when the offset distance Dx is varied by an amount greater than 1.25 mm, which is half of the pitch Px in the X-axis direction, #4 and #8 in a range of 0≤Dx≤1.25 will be described below.

TABLE 1

| | | Worst value [dB] in used frequency band | | |
|---|---|---|---|---|
| Dx [mm] | Dy [mm] | #4 | #8 | Worse value in the left two values |
| 0.00 | 0.00 | 13.3 | 13.7 | 13.3 |
| 0.25 | Same as above | 13.7 | 13.7 | 13.7 |
| 0.50 | Same as above | 14.1 | 13.7 | 13.7 |
| 0.75 | Same as above | 15.0 | 13.9 | 13.9 |
| 1.00 | Same as above | 16.0 | 13.5 | 13.5 |
| 1.25 | Same as above | 16.7 | 14.6 | 14.6 |

As apparent from Table 1, #4 and #8, which are the isolations between the patch antennas adjacent to each other in the polarization direction, are improved as the offset distance Dx shifted in the direction orthogonal to the polarization direction is increased and are most improved when Dx=1.25 mm.

In addition, as apparent from comparison between FIG. 9 and FIG. 10, the isolations between the adjacent patch antennas can most be improved across the used frequency band when Dx=1.25 mm and Dy=0.00 mm, compared with the case in which Dx=0.00 mm and Dy=0.00 mm. In other words, the worst values of #1 to #8 in the used frequency band can most be improved when the offset distance Dx is set to half of the pitch Px in the X-axis direction.

As for the improvement effect of the isolations in the used frequency band, the same effect as in the case in which the offset distance Dx is set to exactly half of the pitch Px is achieved even when the offset distance Dx is set to approximately half of the pitch Px.

With regard to this, #4 and #8 when the offset distance Dy is fixed to Dy=0.00 mm and only the offset distance Dx is varied at intervals of 0.05 mm in a range of 1.10≤Dx≤1.25 are indicated in Table 2.

TABLE 2

| | | Worst value [dB] in used frequency band | | |
|---|---|---|---|---|
| Dx [mm] | Dy [mm] | #4 | #8 | Worse value in the left two values |
| 1.10 | 0.00 | 16.7 | 14.2 | 14.2 |
| 1.15 | Same as above | 16.4 | 14.3 | 14.3 |
| 1.20 | Same as above | 16.5 | 14.6 | 14.6 |
| 1.25 | Same as above | 16.7 | 14.6 | 14.6 |

As apparent from Table 2, the same isolation as in the case in which Dx=1.25 mm can be ensured even when Dx=1.20 mm. In other words, making the offset distance Dx approximately half of the pitch Px enables the isolations in the used frequency band to be most improved. Here, approximately half of the pitch Px is within a range of half of the pitch Px±2% of the pitch Px. For example, when Px=2.5 mm, approximately half of the pitch Px is within a range of 1.25±0.05 mm.

Next, #2 and #6, which are the isolations between the patch antennas adjacent to each other in the direction orthogonal to the polarization direction, are indicated in Table 3 when the offset distance Dx is fixed to Dx=1.25 mm and only the offset distance Dy is varied at intervals of 0.25 mm. Since the other isolations are degraded, compared with #2 and #6, when the offset distance Dy is varied by an amount greater than 1.25 mm, which is half of the pitch Py in the Y-axis direction, #2 and #6 in a range of 0≤Dy≤1.25 will be described below.

TABLE 3

| | | Worst value [dB] in used frequency band | | |
|---|---|---|---|---|
| Dx [mm] | Dy [mm] | #2 | #6 | Worse value in the left two values |
| 1.25 | 0.00 | 15.3 | 16.6 | 15.3 |
| Same as above | 0.25 | 16.3 | 16.7 | 16.3 |
| Same as above | 0.50 | 17.5 | 17.1 | 17.1 |
| Same as above | 0.75 | 18.7 | 17.7 | 17.7 |
| Same as above | 1.00 | 19.7 | 18.5 | 18.5 |
| Same as above | 1.25 | 20.9 | 19.5 | 19.5 |

As apparent from Table 3, #2 and #6, which are the isolations between the patch antennas adjacent to each other in the direction orthogonal to the polarization direction, are improved as the offset distance Dy shifted in the polarization direction is increased and are most improved when Dy=1.25 mm.

In addition, as apparent from comparison between FIG. 9 and FIG. 11A, the isolations between the adjacent patch antennas can generally be improved across the used frequency band when Dx=1.25 mm and Dy=1.25 mm, compared with the orthogonal arrangement.

However, in this case, at least one of #1, #3, #5, and #7, which are the isolations between the patch antennas adjacent to each other in a direction oblique to the polarization direction in the orthogonal arrangement, may be more degraded than the worst value of the isolation in the orthogonal arrangement. As represented in FIG. 11A, in the second simulation model, #5, which is the isolation between the patch antenna 10X and the patch antenna 10E, is more degraded than the worst value of the isolation in the orthogonal arrangement.

In contrast, as represented in FIG. 11B, the isolations between the adjacent patch antennas can most be improved across the used frequency band, compared with the orthogonal arrangement, when Dx=1.25 mm and Dy=0.75 mm. Accordingly, the offset distance Dy in the offset in the Y-axis direction can be appropriately selected based on the isolation of the entire antenna array.

As for the improvement effect of the isolations in the used frequency band, the same effect as in the case in which the offset distance Dy is set to exactly half of the pitch Py is achieved even when the offset distance Dy is set to approximately half of the pitch Py.

With regard to this, #2 and #6 when the offset distance Dx is set to Dx=1.20 mm and 1.25 mm and the offset distance Dy is set to Dy=1.20 mm and 1.25 mm are indicated in Table 4.

TABLE 4

| | | Worst value [dB] in used frequency band | | |
|---|---|---|---|---|
| Dx [mm] | Dy [mm] | #2 | #6 | Worse value in the left two values |
| 1.20 | 1.20 | 20.5 | 19.5 | 19.5 |
| Same as above | 1.25 | 20.7 | 19.7 | 19.7 |
| 1.25 | 1.20 | 20.6 | 19.3 | 19.3 |
| Same as above | 1.25 | 20.9 | 19.5 | 19.5 |

As apparent from Table 4, isolation similar to that in the case in which Dx=1.25 mm and Dy=1.25 mm can be ensured even when Dx=1.20 mm and Dy=1.20 mm, when Dx=1.20 mm and Dy=1.25 mm, or when Dx=1.25 mm and Dy=1.20 mm. In other words, making the offset distance Dx approximately half of the pitch Px and making the offset distance Dy approximately half of the pitch Py enable the isolations in the used frequency band to be most improved. Here, approximately half of the pitch Px is within a range of half of the pitch Px±2% of the pitch Px. For example, when Px=2.5 mm, approximately half of the pitch Px is within a range of 1.25±0.05 mm. Approximately half of the pitch Py is within a range of half of the pitch Py±2% of the pitch Py. For example, when Py=2.5 mm, approximately half of the pitch Py is within a range of 1.25±0.05 mm.

The influence of the arrangement mode of the antenna array on the isolations between the adjacent patch antennas is described above using the first simulation model and the second simulation model. Next, the influence of the arrangement mode of the antenna array on radiation characteristics will be described.

Sidelobe levels in the beam pattern in a case in which the offset distance Dy is fixed to Dy=0.00 mm and only the offset distance Dx is varied are indicated in Table 5. Sidelobe levels in the beam pattern in a case in which the offset distance Dx is fixed to Dx=1.20 mm and 1.25 mm and the offset distance Dy is varied are indicated in Table 6. The level of a first sidelobe having the highest peak intensity is indicated as the sidelobe level in both Table 5 and Table 6. The first sidelobe normally appears nearest to a mainlobe. The level of the sidelobe is the ratio of the peak intensity of the sidelobe to the peak intensity of the mainlobe. The sidelobe levels in the X-Z plane are indicated in an "Azimuth" column and the sidelobe levels in the Y-Z plane are indicated in an "Elevation" column in the tables.

TABLE 5

| | | Sidelobe level [dB] | |
|---|---|---|---|
| Dx [mm] | Dy [mm] | Azimuth | Elevation |
| 0.00 | 0.00 | −13.6 | −17.4 |
| 0.25 | Same as above | −13.7 | −17.5 |
| 0.50 | Same as above | −14.0 | −17.6 |
| 0.75 | Same as above | −14.2 | −17.3 |
| 1.00 | Same as above | −14.9 | −17.3 |
| 1.10 | Same as above | −14.8 | −17.0 |
| 1.15 | Same as above | −15.1 | −17.0 |
| 1.20 | Same as above | −15.2 | −16.9 |
| 1.25 | Same as above | −15.3 | −16.9 |

TABLE 6

| Dx [mm] | Dy [mm] | Sidelobe level [dB] Azimuth | Elevation |
|---|---|---|---|
| 1.20 | 1.20 | −15.2 | −14.0 |
| Same as above | 1.25 | −14.7 | −13.9 |
| 1.25 | 0.00 | −15.3 | −16.9 |
| Same as above | 0.25 | −15.7 | −16.4 |
| Same as above | 0.50 | −15.9 | −15.6 |
| Same as above | 0.75 | −15.9 | −15.3 |
| Same as above | 1.00 | −15.8 | −14.4 |
| Same as above | 1.20 | −14.7 | −13.8 |
| Same as above | 1.25 | −14.6 | −13.7 |

As apparent from these tables, the sidelobe levels are suppressed to −13 dB or less, which is the sidelobe level in principle in the orthogonal arrangement, both when the offset distance Dx>0 and the offset distance Dy=0 and when the offset distance Dx>0 and the offset distance Dy>0. In particular, as indicated in Table 5, the sidelobe levels are generally suppressed, compared with the case in which the offset distance Dx>0 and the offset distance Dy>0 illustrated in FIG. 4C, when the offset distance Dx>0 and the offset distance Dy=0.

The following can be said in consideration of (i) the influence on the isolations between the adjacent patch antennas and (ii) the influence on the radiation characteristics of the arrangement mode of the antenna array described above. Specifically, with the antenna arrays in the present embodiment and the first and second modifications, the isolations can be improved while suppressing the sidelobe levels. In particular, making the offset distance Dx approximately half of the pitch Px and making the offset distance Dy approximately half of the pitch Py enable the isolations to be most improved while suppressing the sidelobe levels.

The sidelobes are suppressed to a level lower than or equal to the sidelobe in principle in the orthogonal arrangement, despite the fact that the multiple patch antennas 10 are not orthogonally arranged, for the following reasons.

The beam pattern of the antenna array is generally given by a product of a "beam pattern per one wave source" and an "array factor". In particular, when the wave sources are arranged so as to be orthogonal to each other and at a regular pitch, the level of the first sidelobe of the array factor is constantly −13 dB in principle regardless of the pitch of the wave sources.

The antenna arrays in the present embodiment and the first and second modifications have a configuration in which multiple units are orthogonally arranged when the patch antennas of two rows and two columns are defined as one unit. Accordingly, the antenna arrays in the present embodiment and the first and second modifications have a configuration in which the multiple wave sources are orthogonally arranged when one unit is considered as one wave source, as in the case in which the multiple patch antennas 10 are orthogonally arranged. Consequently, it is possible to suppress the level of the first sidelobe to −13 dB or less for the beam pattern of the entire antenna array, which is given by the product of the "beam pattern per one wave source" and the "array factor."

In other words, in the antenna arrays in the present embodiment and the first and second modifications, the arrangement of the multiple patch antennas 10 is periodically repeated along the X-axis direction and the Y-axis direction. When the minimum unit in which the arrangement is periodically repeated is defined as the unit for the multiple patch antennas 10, the multiple units are arranged at regular intervals along the X-axis direction and at regular intervals along the Y-axis direction. Specifically, in the present embodiment and the first and second modifications, the units each composed of the patch antennas 10 of two rows and two columns are arranged at regular intervals two times of Px along the X-axis direction and at regular intervals two times of Py along the Y-axis direction.

Here, one of the X-axis direction and the Y-axis direction is the polarization direction and the other thereof is the direction perpendicular to the polarization direction. Accordingly, the multiple units have the orthogonal arrangement in which the multiple units are two-dimensionally arranged at regular intervals in the polarization direction and the direction perpendicular to the polarization direction by arranging the multiple units at regular intervals along the X-axis direction and at regular intervals along the Y-axis direction. Consequently, since the multiple wave sources are orthogonally arranged, as in the normal case in which the multiple patch antennas are orthogonally arranged, when one unit is considered as one wave source, as described above, the sidelobe levels can be suppressed. As a result, in the antenna arrays in the present embodiment and the first and second modifications, since the isolations can be improved while suppressing the sidelobe levels, it is possible to further improve the communication quality.

In the first modification, it can also be said that the units each composed of the patch antennas 10 of two rows and one column are arranged at regular intervals of Px along the X-axis direction and at regular intervals of two times of Py along the Y-axis direction. In the second modification, it can also be said that the units each composed of the patch antennas 10 of one row and two columns are arranged at regular intervals of two times of Px along the X-axis direction and at regular intervals of Py along the Y-axis direction.

[1-2-4. Summary]

As apparent also from the result of the comparison between the first simulation model and the second simulation model, the following advantages are achieved according to the present embodiment.

The X-axis direction, which is the direction perpendicular to the polarization direction of the multiple patch antennas 10, is exemplified as the first direction and the Y-axis direction, which is the polarization direction, is exemplified as the second direction in the following description. However, the correspondence relationship between the first direction and the second direction and the X-axis direction and the Y-axis direction may be replaced, unless otherwise specified. Accordingly, since the same advantages are achieved also in the matters described below, although the matters involved in the replacement of the correspondence relationship are changed, when the correspondence relationship is replaced, a detailed description is omitted herein.

According to the present embodiment, compared with the case in which the multiple patch antennas 10 are orthogonally arranged in the first direction (for example, the X-axis direction) and the second direction (for example, the Y-axis direction), the antenna groups (for example, the antenna groups Row1 to Row4) each composed of the multiple patch antennas 10 arranged in the first direction are arranged so as to be shifted from the other antenna groups adjacent in the second direction by a certain interval (for example, the offset distance Dx) in the first direction.

With the above configuration, focusing on the two patch antennas 10 adjacent to each other in the second direction, one of the two patch antennas 10 is arranged so as to be shifted from the other thereof in the first direction. Accordingly, the interval between the two patch antennas 10 is increased to improve the isolation between the two patch antennas 10. Consequently, since wrapping-around of unnecessary signals to the input-output ports of the radio-frequency circuit component (for example, the RFIC 30) can be suppressed, the communication quality is improved.

In addition, according to the present embodiment, each of the multiple sets of antenna groups is arranged so as to be shifted from another adjacent antenna group by an amount approximately half of the first interval (for example, the pitch Px), which is the interval between the multiple patch antennas 10 composing the same antenna group, in the first direction.

Focusing on one patch antenna 10 of the two patch antennas 10 adjacent to each other in the second direction when the multiple patch antennas 10 are orthogonally arranged, the interval with the other patch antenna 10 is increased as the increasing offset distance in the first direction. However, when the offset distance exceeds half of the first interval, another patch antenna 10 having the interval shorter than the interval of the other patch antenna 10 appears. Accordingly, arranging each of the multiple sets of antenna groups so as to be shifted from another adjacent antenna group by an amount approximately half of the first interval in the first direction enables the distance between the patch antennas 10 composing the adjacent antenna groups to be most increased. Accordingly, since the isolation between the patch antennas 10 composing the adjacent antenna groups can most be improved, the communication quality is further improved.

With regard to this, according to the present embodiment, approximately half of the first interval is within a range of half of the first interval ±2% of the first interval. In this case, isolation similar to that in the case in which each of the multiple sets of antenna groups is arranged so as to be shifted from another adjacent antenna group by an amount exactly half of the first interval in the first direction can be ensured. The similar isolation means not only that the isolations are completely equal to each other but also that the isolations are approximately equal to each other. The similar isolation includes a case in which the isolations are different from each other within an error range (for example, a range of 0.2 dB or less and, more limitedly, a range of 0.1 dB or less).

Furthermore, according to the present embodiment, each of the multiple patch antennas 10 composing each of the multiple sets of antenna groups is arranged so as to be shifted from another adjacent patch antenna 10 by a certain interval (for example, the offset distance Dy) in the second direction.

With the above configuration, focusing on the two patch antennas 10 adjacent in the first direction when the multiple patch antennas 10 are orthogonally arranged, one of the two patch antennas 10 is arranged so as to be shifted from the other thereof in the second direction. Here, each of the two patch antennas 10 is arranged so as to be shifted in the first direction from the patch antenna 10 adjacent in the second direction in the orthogonal arrangement. In other words, focusing on one patch antenna 10, in the orthogonal arrangement, the interval between the patch antenna 10 and another patch antenna 10 adjacent in the first direction and the interval between the patch antenna 10 and another patch antenna 10 adjacent in the second direction are increased. Accordingly, since both the isolation between each of the multiple patch antennas 10 composing the antenna module 1 and another patch antenna 10 adjacent in the first direction in the orthogonal arrangement and the isolation between each of the multiple patch antennas 10 composing the antenna module 1 and another patch antenna 10 adjacent in the second direction in the orthogonal arrangement can be improved, the communication quality is further improved.

Furthermore, according to the present embodiment, each of the multiple sets of antenna groups is arranged so as to shifted from another adjacent antenna group by an amount approximately half of the first interval in the first direction and each of the multiple patch antennas 10 composing the antenna group is arranged so as to be shifted from another adjacent patch antenna 10 by an amount approximately half of the second interval (for example, the pitch Py) in the second direction.

With the above configuration, since both the isolation between each of the multiple patch antennas 10 composing the antenna module 1 and another patch antenna 10 adjacent in the first direction in the orthogonal arrangement and the isolation between each of the multiple patch antennas 10 composing the antenna module 1 and another patch antenna 10 adjacent in the second direction in the orthogonal arrangement can be improved, the communication quality is further improved.

With regard to this, according to the present embodiment, approximately half of the first interval is within a range of half of the first interval ±2% of the first interval and approximately half of the second interval is within a range of half of the second interval ±2% of the second interval. In this case, isolation similar to that in the case in which (i) each of the multiple sets of antenna groups is arranged so as to be shifted from another adjacent antenna group by an amount exactly half of the first interval in the first direction and (ii) each of the multiple patch antennas 10 composing each of the multiple sets of antenna groups is arranged so as to be shifted from another adjacent patch antenna by an amount exactly half of the second interval in the second direction can be ensured.

Furthermore, according to the present embodiment, since similar losses occur in the multiple feeder lines because the lengths of the multiple feeder lines are equal to each other, it is possible to suppress degradation of antenna characteristics caused by a variation in the loss.

Furthermore, according to the present embodiment, since the radio-frequency circuit component mounted on the second main surface side of the dielectric substrate is the RFIC, the communication quality is improved in the antenna module 1 in which the multiple patch antennas 10 are integrated with the RFIC.

Furthermore, with the antenna modules including the antenna arrays in the first modification and the second modification, the multiple patch antennas 10 composing each of the multiple sets of antenna groups are arranged on a straight line extending in the first direction (the X-axis direction in the first modification and the Y-axis direction in the second modification).

With the above configuration, it is possible to suppress the sidelobe levels, compared with the case in which the multiple patch antennas 10 composing each of the multiple sets of antenna groups are not arranged on a straight line but are arranged so as to be shifted.

Furthermore, with the antenna module including the antenna array in the first modification, the first direction is the direction perpendicular to the polarization direction and the second direction is the polarization direction.

The isolation between the patch antennas 10 adjacent in the polarization direction in the orthogonal arrangement is especially poor, compared with the isolation between the other patch antennas 10. Accordingly, arranging each of the multiple sets of antenna groups so as to be shifted from another antenna group adjacent in the polarization direction, which is the second direction, by a certain interval in the direction perpendicular to the polarization direction enables the isolation between the patch antennas 10 adjacent in the polarization direction in the orthogonal arrangement to be improved. Consequently, since wrapping-around of unnecessary signals to the input-output ports of the radio-frequency circuit component can effectively be suppressed, the communication quality is further improved.

[2. Communication Apparatus]

The antenna module 1 according to the present embodiment is capable of composing a communication apparatus with the BBIC described below.

With regard to this, the antenna module 1 according to the present embodiment is capable of realizing sharp directivity by controlling the phase and the signal strength of the radio-frequency signal emitted from each patch antenna 10. Such an antenna module 1 can be used in, for example, a communication apparatus supporting Massive Multiple Input Multiple Output (MIMO), which is one of wireless transmission technologies promising for 5G (fifth-generation mobile communication system).

Such a communication apparatus will be now described, with the processing in the RFIC 30 in the antenna module 1.

Figure 12:
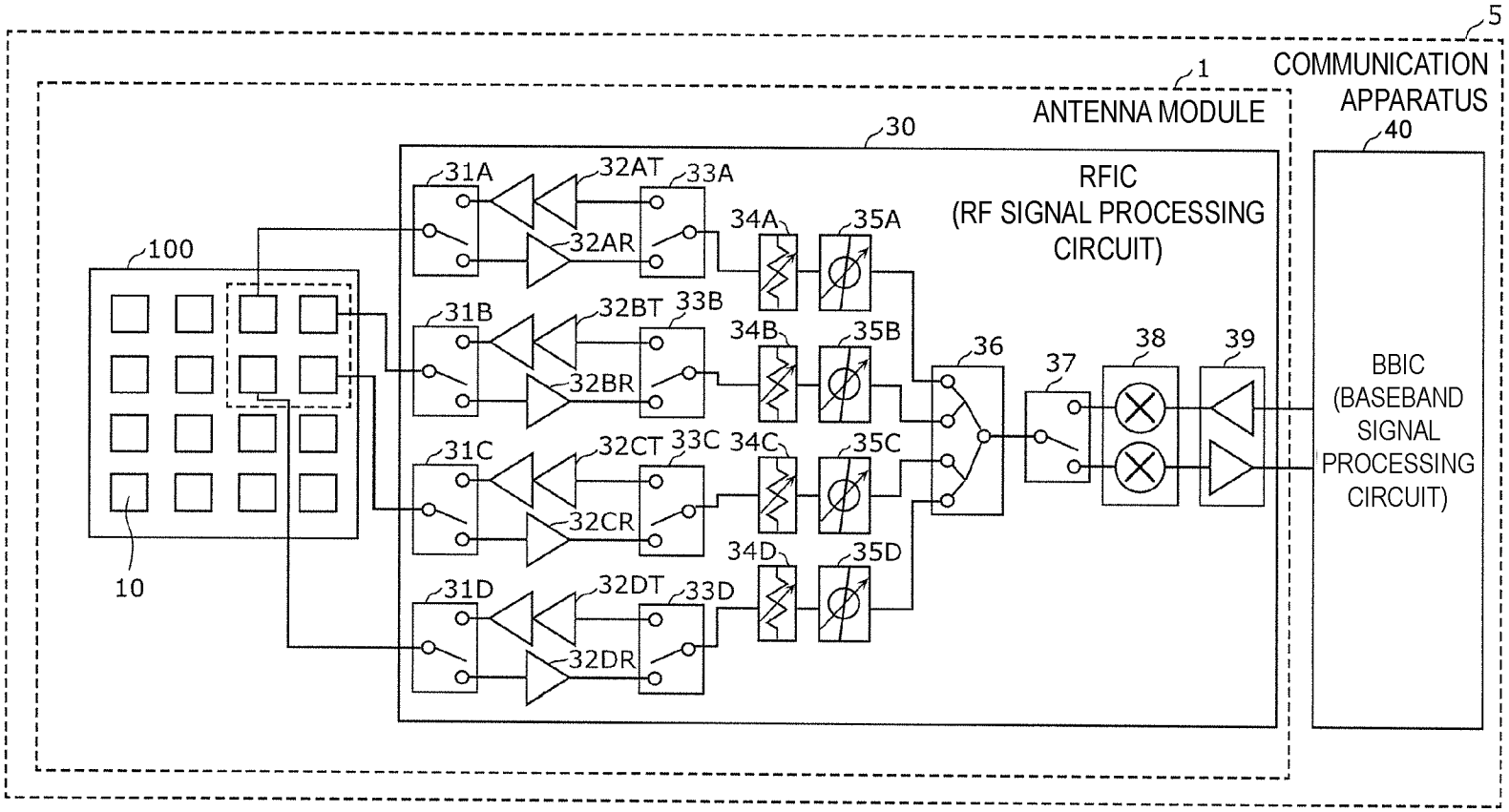
FIG. 12 is a circuit block diagram illustrating the configuration of a communication apparatus including the antenna module according to the present embodiment.

FIG. 12 is a circuit block diagram illustrating the configuration of a communication apparatus 5 including the antenna module 1 according to the present embodiment. Only circuit blocks corresponding to four patch antennas 10, among the multiple patch antennas 10 in the antenna array 100, are illustrated as the circuit blocks in the RFIC 30 and the other circuit blocks are omitted in FIG. 12 for simplicity. In the following description, the circuit blocks corresponding to these four patch antennas 10 are described and a description of the other circuit blocks is omitted.

Referring to FIG. 12, the communication apparatus 5 includes the antenna module 1 and a BBIC 40 composing a baseband signal processing circuit.

The antenna module 1 includes the antenna array 100 and the RFIC 30, as described above.

The RFIC 30 includes switches 31A to 31D, 33A to 33D, and 37, power amplifiers 32AT to 32DT, low noise amplifiers 32AR to 32DR, attenuators 34A to 34D, phase shifters 35A to 35D, a signal multiplexer-demultiplexer 36, a mixer 38, and an amplifier circuit 39.

The switches 31A to 31D and 33A to 33D are switch circuits that switch between transmission and reception through the respective signal paths.

A signal transmitted from the BBIC 40 to the RFIC 30 is amplified in the amplifier circuit 39 and is subjected to the up-conversion in the mixer 38. The radio-frequency signal subjected to the up-conversion is demultiplexed in the signal multiplexer-demultiplexer 36, passes through four transmission paths, and supplied to different patch antennas 10. At this time, the degrees of phase shift in the phase shifters 35A to 35D arranged on the respective signal paths are individually adjusted to enable adjustment of the directivity of the antenna array 100.

Radio-frequency signals received with the respective patch antennas 10 in the antenna array 100 pass through four different reception paths, are multiplexed in the signal multiplexer-demultiplexer 36, are subjected to the down-conversion in the mixer 38, are amplified in the amplifier circuit 39, and are supplied to the BBIC 40.

Any of the switches 31A to 31D, 33A to 33D, and 37, the power amplifiers 32AT to 32DT, the low noise amplifiers 32AR to 32DR, the attenuators 34A to 34D, the phase shifters 35A to 35D, the signal multiplexer-demultiplexer 36, the mixer 38, and the amplifier circuit 39 described above may not be provided in the RFIC 30. In addition, the RFIC 30 may include only either of the transmission paths and the reception paths. Furthermore, the communication apparatus 5 according to the present embodiment is also applicable to a system that not only transmits and receives the radio-frequency signals in a single frequency band but also transmits and receives the radio-frequency signals in multiple frequency bands (multiband).

As described above, the RFIC 30 includes the power amplifiers 32AT to 32DT, which amplify the radio-frequency signals, and the multiple patch antennas 10 emit the signals amplified in the amplifiers 32AT to 32DT.

With such a communication apparatus 5, providing the antenna module 1 according to the present embodiment improves the isolation between the patch antennas 10. Accordingly, since wrapping-around of unnecessary signals to the input-output ports of the RFIC 30 is suppressed, the communication quality is improved.

(Modifications)

Although the antenna modules and the communication apparatus according to the embodiment of the present disclosure and the examples of the embodiment are described above, the present disclosure is not limited to the above embodiment and the examples of the embodiment. Other embodiments realized by combining arbitrary components in the above embodiment, modifications resulting from making various changes supposed by the persons skilled in the art to the above embodiment without departing from the scope and sprit of the present disclosure, and various devices incorporating the antenna module and the communication apparatus of the present disclosure are also included in the present disclosure.

For example, the patch antennas are described to be arranged so as to be shifted every second row or every second column in the antenna array in the above description. In other words, in the antenna array, the same arrangement mode is described to be repeated, for example, for every two rows and every two columns. However, the arrangement mode of the antenna array is not limited to this and the antenna array may have a configuration in which the same arrangement mode is repeated for every m-number rows and every n-number columns (m and n are integers at least one of which is greater than or equal to three). In other words, it is sufficient for the antenna array to be configured by periodically translating the m×x n patch antennas 10 of the m-number rows and the n-number columns to expand the antenna array.

The pitch Px in the X-axis direction may be equal to or may be different from the pitch Py in the Y-axis direction. The pitch Py in the X-axis direction and the pitch Py in the Y-axis direction may be appropriately designed in consideration of, for example, the beam pattern that is required.

Although the lengths of the multiple feeder lines 22 are approximately equal to each other in the above description, the multiple feeder lines 22 may include the feeder lines 22 having different lengths. For example, when the radio-frequency circuit component includes the phase shifters 35A to 35D, which vary the phases of the radio-frequency signals, the lengths of the multiple feeder lines 22 may be different from each other or the length of at least part of the multiple feeder lines 22 may be different from the lengths of the other feeder lines 22. Specifically, it is sufficient for the length of each of the multiple feeder lines 22 to be approximately equal to an arbitrary integer multiple of the electrical length corresponding to one step, which is the minimum unit in which the phases of the phase shifters 35A to 35D are varied. With the above configuration, when phase correction with the phase shifters 35A to 35D is performed, it is possible to supply electric power of a desired phase to all the multiple patch antennas 10.

As for the feeder lines 22, "the lengths are approximately equal to each other" means that the difference between the lengths of the multiple feeder lines 22 is within 3% of the wavelength of the radio-frequency signal in the dielectric substrate 20, as described above. In other words, the length of each of the multiple feeder lines 22 is approximately equal to a certain length means that the difference between the length of each feeder line 22 and the certain length is within 3% described above.

With regard to this, in the phase shifters 35A to 35D of 32 steps (that is, five bits), one step is 3.125% of the wavelength of the radio-frequency signal in the dielectric substrate 20. Accordingly, making the difference within 3% of the wavelength of the radio-frequency signal in the dielectric substrate 20 enables the influence of the lengths of the feeder lines 22 on the characteristics to be greatly suppressed. Accordingly, the communication quality is further improved.

In addition, although the RFIC 30 is exemplified to have the configuration in which both the transmission-system signal processing and the reception-system signal processing are performed in the above description, the RFIC 30 is not limited to this. The RFIC 30 may perform either of the transmission-system signal processing and the reception-system signal processing.

Although the RFIC 30 is exemplified as the radio-frequency circuit component in the above description, the radio-frequency circuit component is not limited to this. For example, the radio-frequency circuit component may be a power amplifier that amplifies the radio-frequency signal and the multiple patch antennas 10 may emit the signal amplified in the power amplifier. Alternatively, for example, the radio-frequency circuit component may be a phase adjustment circuit that adjusts the phases of the radio-frequency signals transmitted between the multiple patch antennas 10 and the radio-frequency circuit component.

The present disclosure can widely be used in a communication device, such as a millimeter wave band mobile communication system and a Massive MIMO system, as the antenna module in which the multiple patch antennas are integrated with the radio-frequency circuit component.

1 antenna module
5 communication apparatus
10, 10A to 10H, 10X patch antenna
10*p* feeding point
20 dielectric substrate
21 substrate body
22 feeder line
30 RFIC
31A, 31B, 31C, 31D, 33A, 33B, 33C, 33D, 37 switch
32AR, 32BR, 32CR, 32DR low noise amplifier
32AT, 32BT, 32CT, 32DT power amplifier
34A, 34B, 34C, 34D attenuator
35A, 35B, 35C, 35D phase shifter
36 signal multiplexer-demultiplexer
38 mixer
39 amplifier circuit
40 BBIC
100, 100A, 100B, 100T antenna array
111 non-feed element
112 feed element
121 pattern conductor
122 via conductor
123 ground pattern conductor
131 input-output terminal
Co11, Co12, Co13, Co14, Row1, Row2, Row3, Row4 antenna group

The invention claimed is:

1. An antenna module comprising:

a dielectric substrate;

a plurality of patch antennas provided at a first main surface side of the dielectric substrate; and a radio-frequency circuit component mounted on a second main surface side opposite to the first main surface of the dielectric substrate, a radio-frequency signal being transmitted between the plurality of patch antennas and the radio-frequency circuit component, wherein the radio-frequency circuit component is arranged in an area in which the plurality of patch antennas is arranged in a plan view of the dielectric substrate, wherein the plurality of patch antennas includes multiple sets of antenna groups each composed of multiple patch antennas periodically arranged at a first interval in a first direction, and the first direction is one of a polarization direction and a direction perpendicular to the polarization direction, wherein the first direction is one of an X-axis direction or a Y-axis direction and the second direction is the other one of the X-axis direction or the Y-axis direction, wherein sides of the multiple patch antennas are parallel to the first direction and the second direction, respectively, wherein the multiple sets of antenna groups is periodically arranged at a second interval in a second direction, and the second direction is another one of the polarization direction and the direction perpendicular to the polarization direction, wherein each of the multiple sets of antenna groups is arranged so as to be shifted from another antenna group adjacent in the second direction by a certain interval in the first direction, and wherein each of the plurality of patch antennas composing each of the multiple sets of antenna groups is arranged so as to be shifted from another adjacent patch antenna by a certain interval in the second direction.

2. The antenna module according to claim 1, wherein an arrangement of the plurality of patch antennas composing the multiple sets of antenna groups is periodically repeated in the first direction and the second direction, and wherein, when a minimum unit in which the arrangement is periodically repeated is defined as a unit for the plurality of patch antennas, a plurality of the units is arranged at regular intervals along the first direction and at regular intervals along the second direction.

3. The antenna module according to claim 2, wherein each of the multiple sets of antenna groups is arranged so as to be shifted from another adjacent antenna group by an amount approximately half of the first interval in the first direction.

4. The antenna module according to claim 2, wherein an arrangement of the plurality of patch antennas composing the multiple sets of antenna groups is periodically repeated in the first direction and the second direction.

5. The antenna module according to claim 2,
wherein the plurality of patch antennas composing each of the multiple sets of antenna groups is arranged on a straight line extending in the first direction.

6. The antenna module according to claim 1,
wherein an arrangement of the plurality of patch antennas composing the multiple sets of antenna groups is periodically repeated in the first direction and the second direction.

7. The antenna module according to claim 6,
wherein each of the multiple sets of antenna groups is arranged so as to be shifted from another adjacent antenna group by an amount approximately half of the first interval in the first direction, and
wherein each of the plurality of patch antennas composing each of the multiple sets of antenna groups is arranged so as to be shifted from another adjacent patch antenna by an amount approximately half of the second interval in the second direction.

8. The antenna module according to claim 7,
wherein the amount approximately half of the first interval is within a range of half of the first interval ±2% of the first interval, and
wherein the amount approximately half of the second interval is within a range of half of the second interval ±2% of the second interval.

9. The antenna module according to claim 1,
wherein the plurality of patch antennas composing each of the multiple sets of antenna groups is arranged on a straight line extending in the first direction.

10. The antenna module according to claim 9,
wherein the first direction is a direction perpendicular to the polarization direction and the second direction is the polarization direction.

11. The antenna module according to claim 1,
wherein the dielectric substrate includes a plurality of feeder lines connecting each of the plurality of patch antennas to the radio-frequency circuit component,
wherein the radio-frequency circuit component includes a phase shifter changing a phase of the radio-frequency signal, and
wherein a length of each of the plurality of feeder lines is approximately equal to an arbitrary integer multiple of an electrical length corresponding to one step, and the one step is a minimum unit changing the phase of the phase shifter.

12. The antenna module according to claim 11,
wherein the lengths of the feeder lines are approximately equal to each other means that a difference between the lengths of the feeder lines is within ±3% of a wavelength of the radio-frequency signal in the dielectric substrate.

13. The antenna module according to claim 1,
wherein the dielectric substrate includes a plurality of feeder lines connecting each of the plurality of patch antennas to the radio-frequency circuit component, and
wherein lengths of the feeder lines are approximately equal to each other.

14. The antenna module according to claim 1,
wherein the radio-frequency circuit component is a radio frequency integrated circuit processing the radio-frequency signal.

15. A communication apparatus comprising:
the antenna module described in claim 14; and
a base band integrated circuit,
wherein the radio frequency integrated circuit is configured to perform at least one of a transmission-system signal processing in which a signal supplied from the base band integrated circuit is subjected to up conversion and the signal is supplied to the plurality of patch antennas and a reception-system signal processing in which radio-frequency signals supplied from the plurality of patch antennas are subjected to down conversion and the signals are supplied to the base band integrated circuit.

16. An antenna module comprising:
a dielectric substrate;
a plurality of patch antennas provided at a first main surface side of the dielectric substrate; and
a radio-frequency circuit component mounted on a second main surface side opposite to the first main surface of the dielectric substrate, a radio-frequency signal being transmitted between the plurality of patch antennas and the radio-frequency circuit component,
wherein the radio-frequency circuit component is arranged in an area in which the plurality of patch antennas is arranged in a plan view of the dielectric substrate,
wherein the plurality of patch antennas includes multiple sets of antenna groups each composed of multiple patch antennas periodically arranged at a first interval in a first direction, and the first direction is one of a polarization direction and a direction perpendicular to the polarization direction,
wherein the multiple sets of antenna groups is periodically arranged at a second interval in a second direction, and the second direction is another one of the polarization direction and the direction perpendicular to the polarization direction,
wherein each of the multiple sets of antenna groups is arranged so as to be shifted from another antenna group adjacent in the second direction by a certain interval in the first direction, and
wherein each of the multiple sets of antenna groups is arranged so as to be shifted from another adjacent antenna group by an amount approximately half of the first interval in the first direction.

17. The antenna module according to claim 16,
wherein the amount approximately half of the first interval is within a range of half of the first interval ±2% of the first interval.

18. The antenna module according to claim 17,
wherein an arrangement of the plurality of patch antennas composing the multiple sets of antenna groups is periodically repeated in the first direction and the second direction.

19. The antenna module according to claim 16,
wherein an arrangement of the plurality of patch antennas composing the multiple sets of antenna groups is periodically repeated in the first direction and the second direction.

20. The antenna module according to claim 16,
wherein the plurality of patch antennas composing each of the multiple sets of antenna groups is arranged on a straight line extending in the first direction.

* * * * *